US006067892A

United States Patent [19]

Erickson

[11] Patent Number: 6,067,892

[45] Date of Patent: May 30, 2000

[54] ARTIFICIAL MUSCLE ACTUATOR ASSEMBLY

[76] Inventor: Joel R. Erickson, 7636 Cir. Hill Dr., Oakland, Calif. 94605

[21] Appl. No.: 09/044,688

[22] Filed: Mar. 18, 1998

[51] Int. Cl.[7] ..... F01B 19/00

[52] U.S. Cl. ..... 92/92; 92/93

[58] Field of Search ..... 92/89, 91, 92, 92/93, 105

[56] References Cited

U.S. PATENT DOCUMENTS

| | | | |
|---|---|---|---|
| 489,193 | 1/1893 | Mills et al. . | |
| 2,373,455 | 4/1945 | Carey . | |
| 2,483,088 | 9/1949 | De Haven . | |
| 2,544,119 | 3/1951 | Wolfe . | |
| 2,545,947 | 3/1951 | Felip et al. . | |
| 2,578,854 | 12/1951 | Stewart . | |
| 2,696,010 | 12/1954 | Robinson . | |
| 2,704,556 | 3/1955 | Blish . | |
| 2,991,763 | 7/1961 | Marette | 92/89 X |
| 3,050,152 | 8/1962 | Blain . | |
| 3,830,519 | 8/1974 | Lewis . | |
| 3,864,983 | 2/1975 | Jacobsen . | |
| 3,882,551 | 5/1975 | Helmer et al. . | |
| 3,945,867 | 3/1976 | Heller, Jr. et al. . | |
| 4,078,670 | 3/1978 | Francois et al. . | |
| 4,350,167 | 9/1982 | Heimlich | 92/92 X |
| 4,393,728 | 7/1983 | Larson et al. . | |
| 4,739,692 | 4/1988 | Wassam et al. . | |
| 4,751,869 | 6/1988 | Paynter . | |
| 4,819,547 | 4/1989 | Kukolj . | |
| 4,841,845 | 6/1989 | Beullens . | |
| 4,843,921 | 7/1989 | Kremer . | |
| 5,014,600 | 5/1991 | Krauter et al. . | |
| 5,021,064 | 6/1991 | Caines . | |
| 5,052,273 | 10/1991 | Sakaguchi . | |

(List continued on next page.)

OTHER PUBLICATIONS

Schulte, Jr., "The Characteristics of the McKibben Artificial Muscle", [source unknown] pp. 94–115 (about 1960).

Chou, et al., "Static and Dynamic Characteristics of McKibben Pneumatic Artificial Muscles", *IEEE*, pp. 281–286 (1994).

Osada, et al., "Intelligent Gels", *Scientific American*, pp. 82–87 (May 1993).

Meghdari, et al., "Exploring Artificial Muscles as Actuators for Artificial Hands", *Intelligent Structures, Materials and Vibrations*, ASME DE–vol. 58, pp. 21–26 (1993).

(List continued on next page.)

*Primary Examiner*—Hoang Nguyen

*Attorney, Agent, or Firm*—Beyer & Weaver, LLP

[57] ABSTRACT

A flexible actuator assembly (20) including a flexible bladder device (22) having an expandable sealed chamber (23) adapted to substantially directionally displace between a deflated condition and an inflated condition, displacing a proximal portion (25) of the bladder device (22) away from a distal portion (26) thereof. An elongated tendon member (27) includes a distal portion (28) oriented outside the chamber (23), while an anchor portion (30) extends into the chamber (23) through a distal opening (31) in the bladder device (22). The tendon anchor portion (30) is further coupled proximate to the bladder proximal portion (25) in a manner adapted to: selectively invert displaceable portions (32) of the bladder device (22) when urged toward the deflated condition to position the anchor portion (30) and the bladder proximal portion (25) relatively closer to the bladder distal portion (26); and selectively evert the inverted displaceable portions (32) of the bladder device (22) when displaced toward the inflated condition which positions the anchor portion (30) and the bladder proximal portion (25) relatively farther away from the bladder distal portion (26) for selective movement of the tendon distal portion (28) between an extended condition and a retracted condition, respectively.

28 Claims, 14 Drawing Sheets

U.S. PATENT DOCUMENTS

| | | | |
|---|---|---|---|
| 5,080,000 | 1/1992 | Bubic . | |
| 5,254,885 | 10/1993 | Robertson | 92/92 X |
| 5,351,602 | 10/1994 | Monroe . | |
| 5,394,766 | 3/1995 | Johnson et al. . | |
| 5,443,504 | 8/1995 | Hill . | |
| 5,443,521 | 8/1995 | Knoth et al. . | |
| 5,474,485 | 12/1995 | Smrt . | |

OTHER PUBLICATIONS

Hesselroth, et al., "Neural Network Control of a Pneumatic Robot Arm", *IEEE Transactions on Systems, Man. and Cybernetics*, vol. 24, No. 1, pp. 28–38 (Jan. 1994).

Lovchik, C., "Space Compatible Dexterous Robotic Hand", pp. 1–3, *Dexterity Systems*, posted on this website, "http://tommy.jsc.nasa.gov/ARSD/report _FY95/lovchik fy9513.html", by at least Feb. 1998.

Paul, E., "Novel Robotic Actuators", pp. 1–2, posted on this website, "http://www/epindustries.com/muscle/muscle-.htm", by at least May 1988.

Author Unknown, "Pneumatic Muscle (ROMAC) Robotic Gripper", pp. 1–4, posted on this website, "http://www-.dataflux.bc.ca/home/asa/projs/romac.html", by at least Apr. 1998.

Author Unknown, "Pneumatic Robot (SoftArm)", pp. 1–4, posted on this website, "http://www.ks.uiuc.edu/~zeller/robot.html", by at least Nov. 1997.

Klute, G., "McKibben Artificial Muscles", pp. 1–5, posted on this website, "http://rcs.ee.washington.edu/BRL/new/devices/mckibben/", by at least Jan. 1998.

Chou, C., "The Antroform Arm Pictorial", pp. 1–3, posted on this website, "http://rcs.ee.washington.edu/brl/people/ccp/aarm.html", by at least Feb. 1998.

Tondu, B., "Naturally Compliant Robot–Arms Actuated by McKibbon Artificial Muscles", *IEEE*, vol. 3, pp. 2635–2640, Oct. 1994.

E.P. Industries, "Bioengineered Novel Robotic Actuators for Utilization in Neuromuscular Control", pp. 1–13, posted on this website, "http://www.epindustries.com/robotics/actuator/webspie.htm", by at least Feb. 1998.

Erickson, J., "What are Crobotics", 16 pages, posted on this website, "http://www.crobitics.com", in Apr. 1996.

Brock, et al. "A Dynamic Model of a Linear Actuator Based on Polymer Hydrogel", pp. 1–15, posted on this website, "http://www.ai.mit.edu/projects/muscle/papers/icim94/paper.html", by at least 1990.

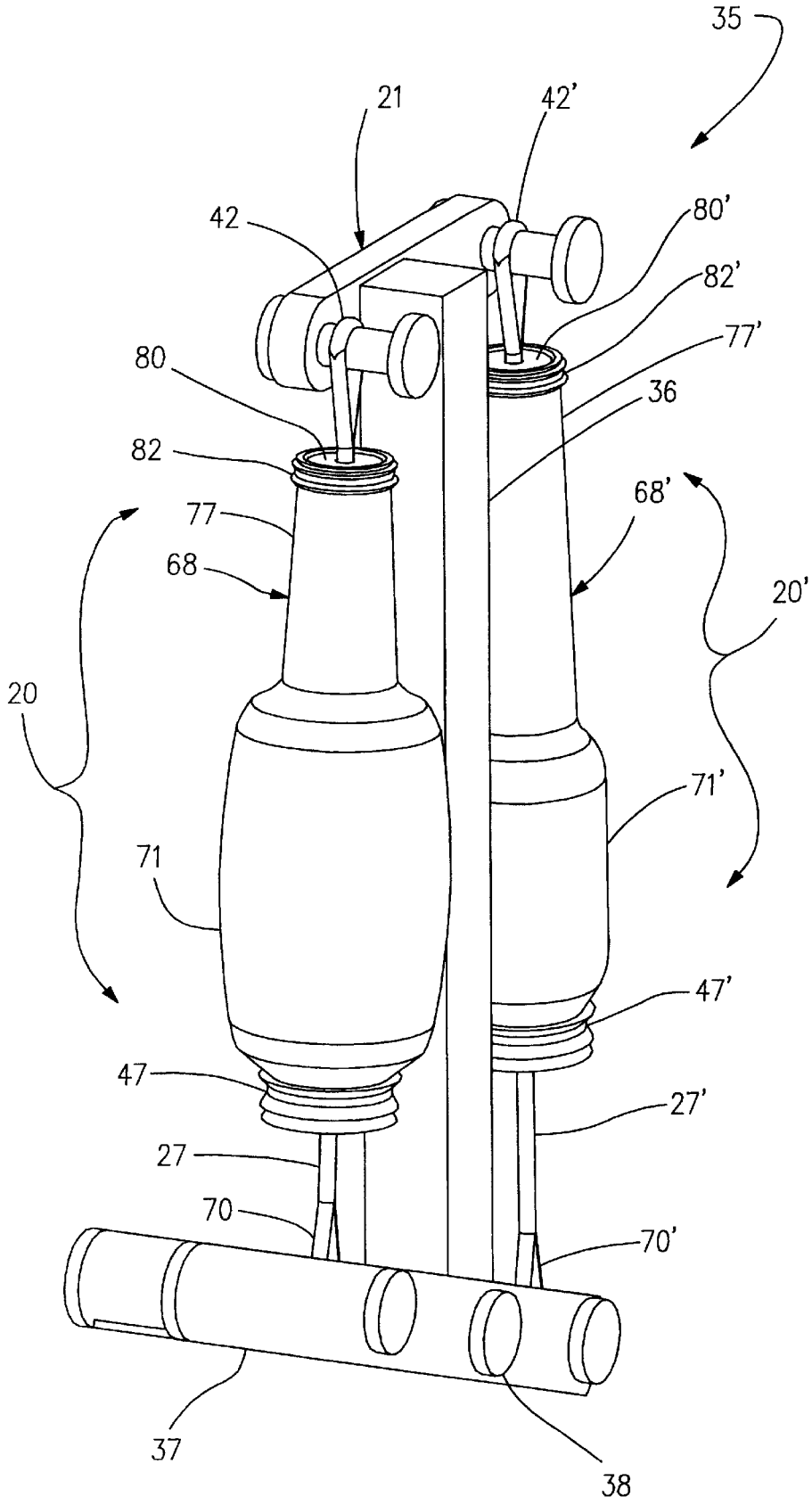
FIG.__1A

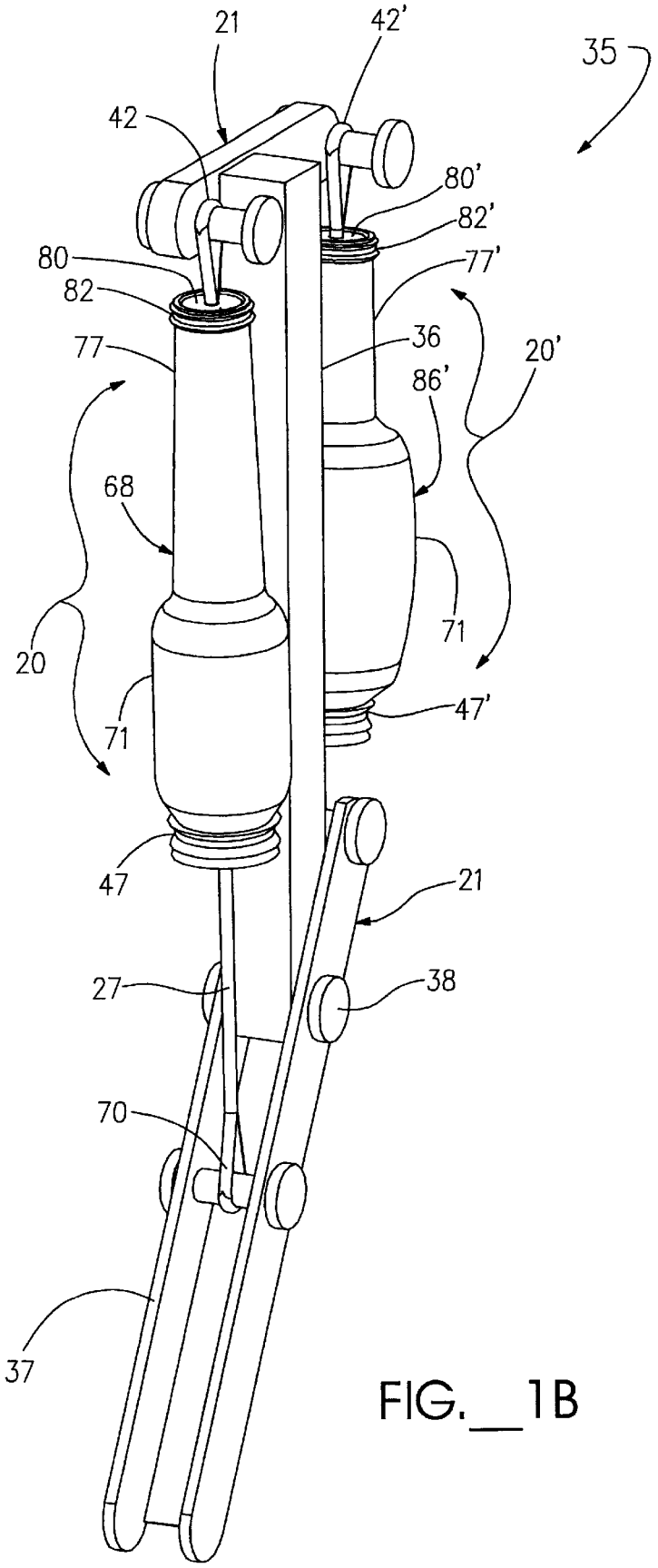
FIG.__1B

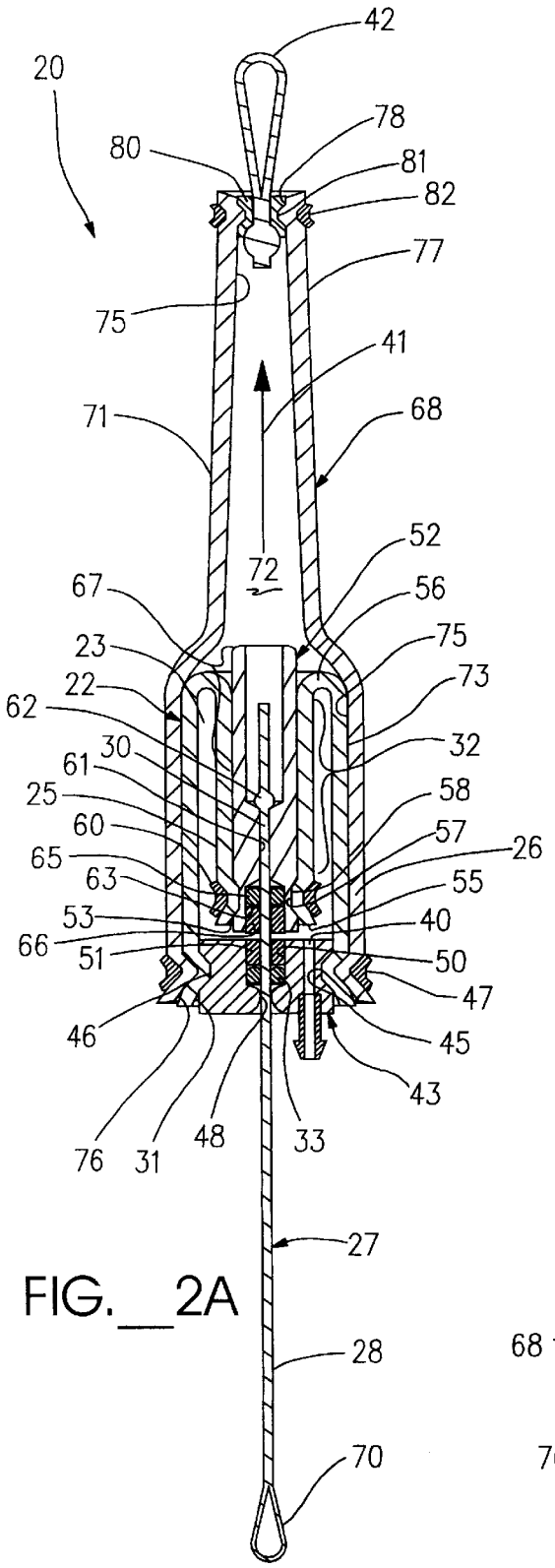
FIG.__2A
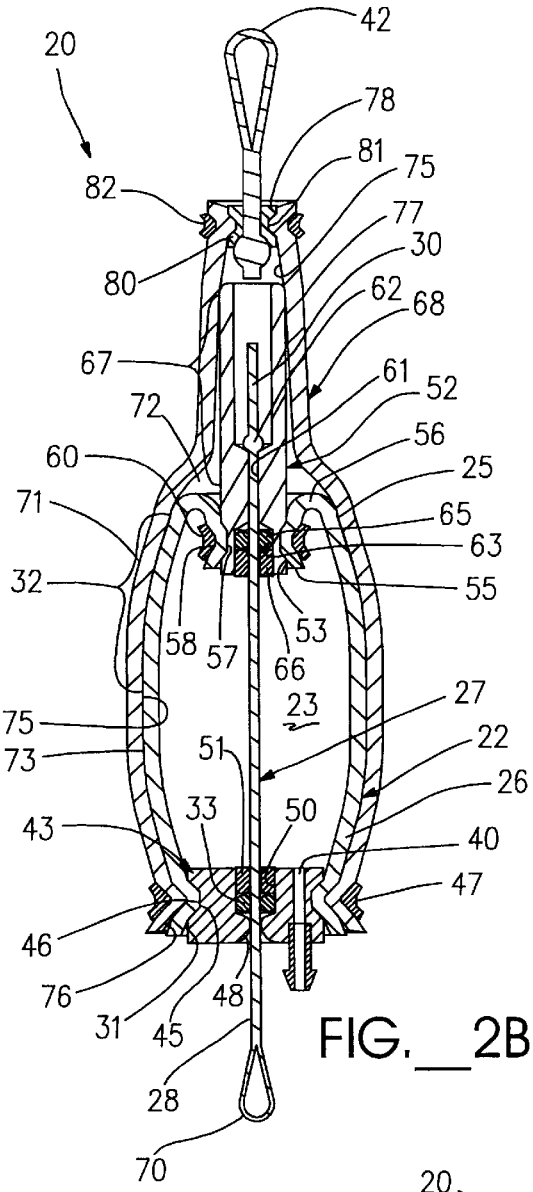
FIG.__2B
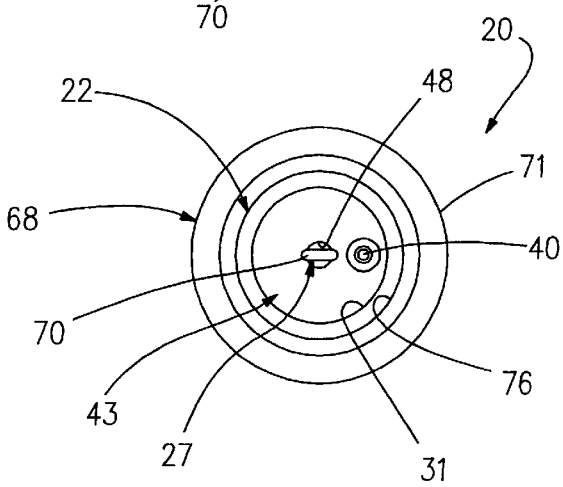
FIG.__2C

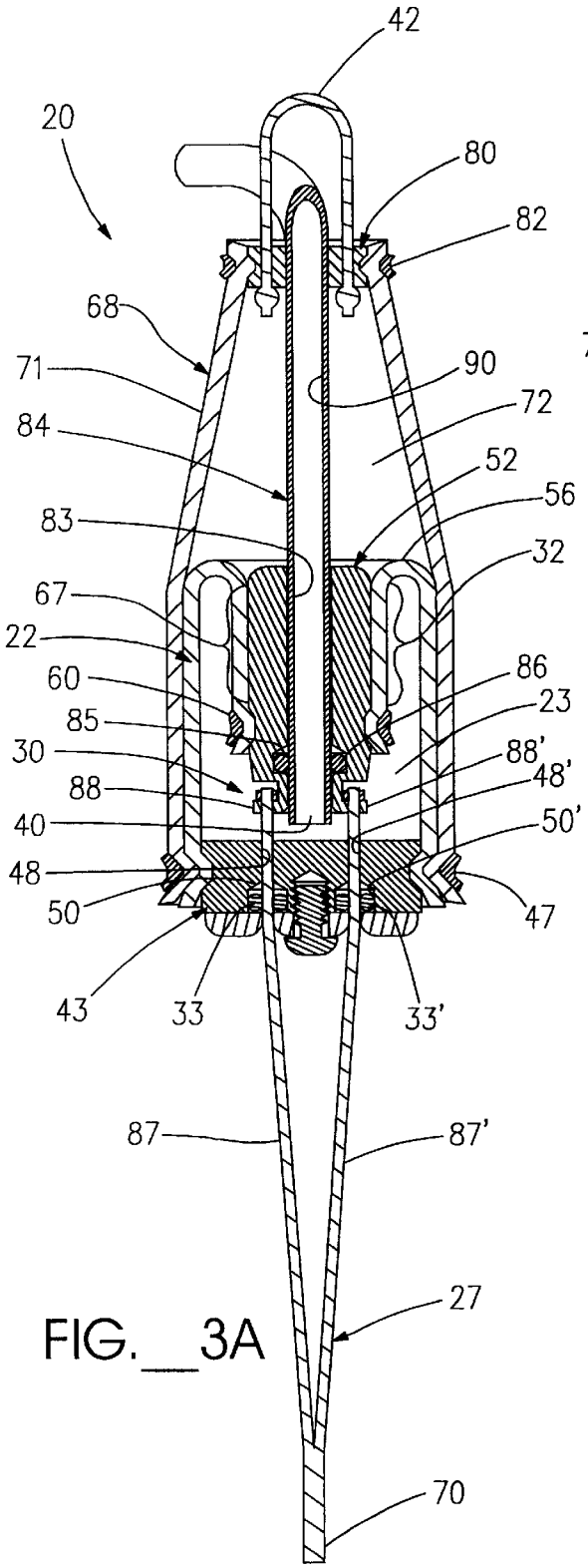
FIG.__3A
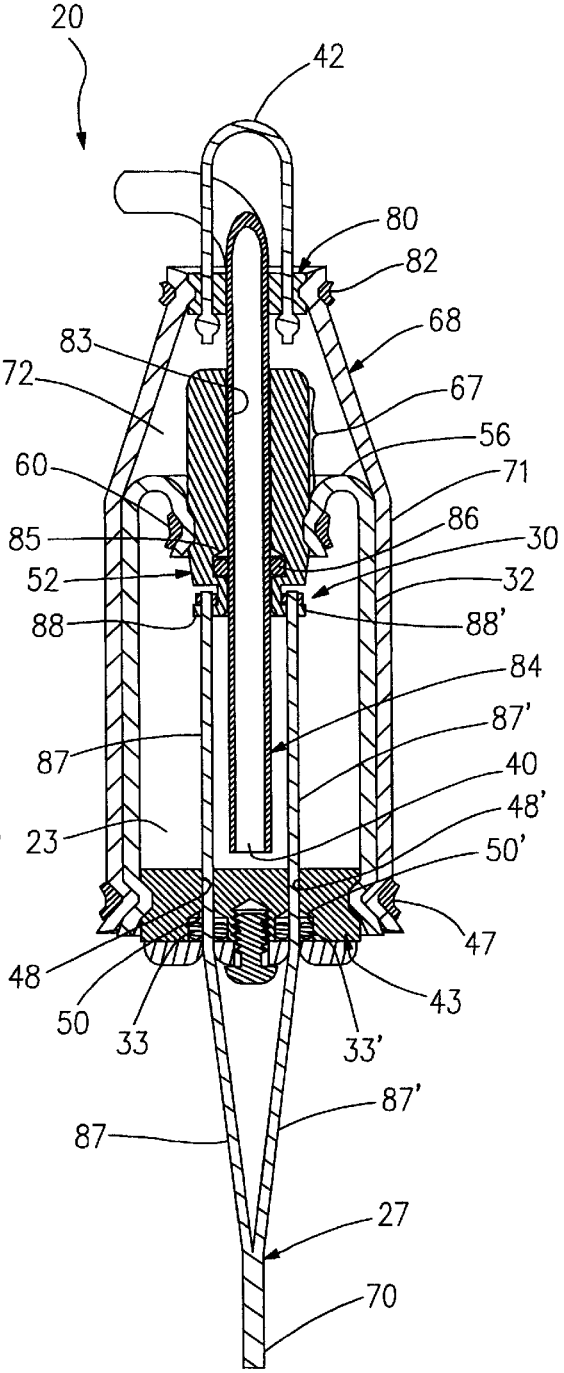
FIG.__3B

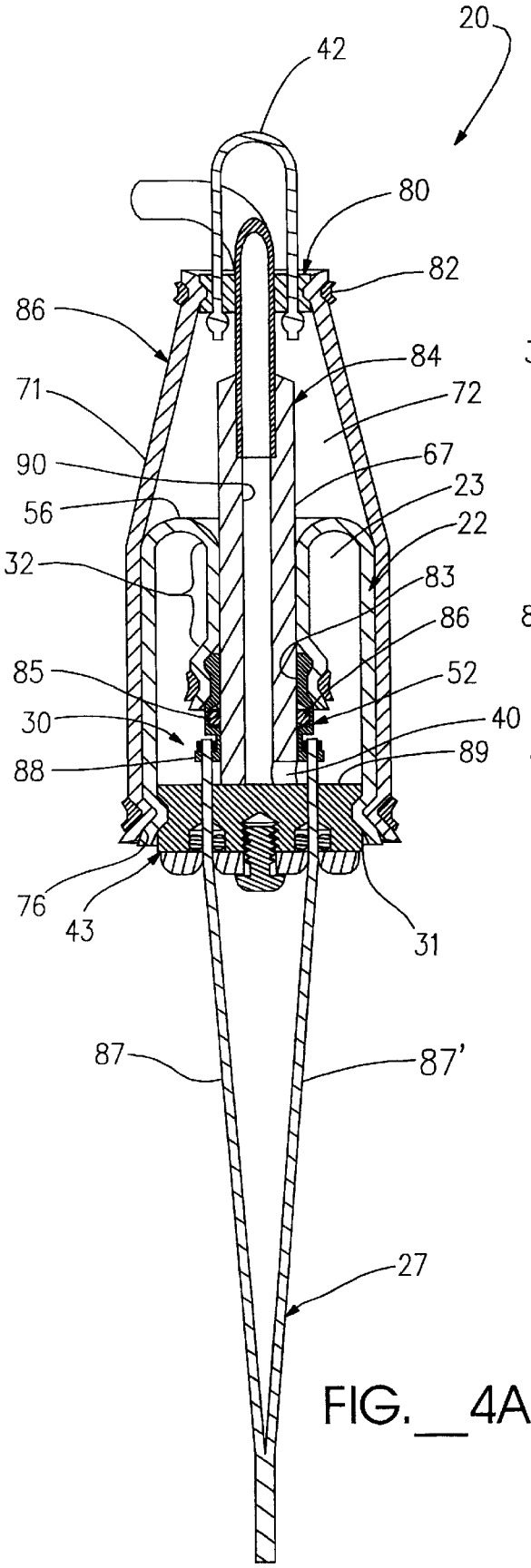
FIG.__4A
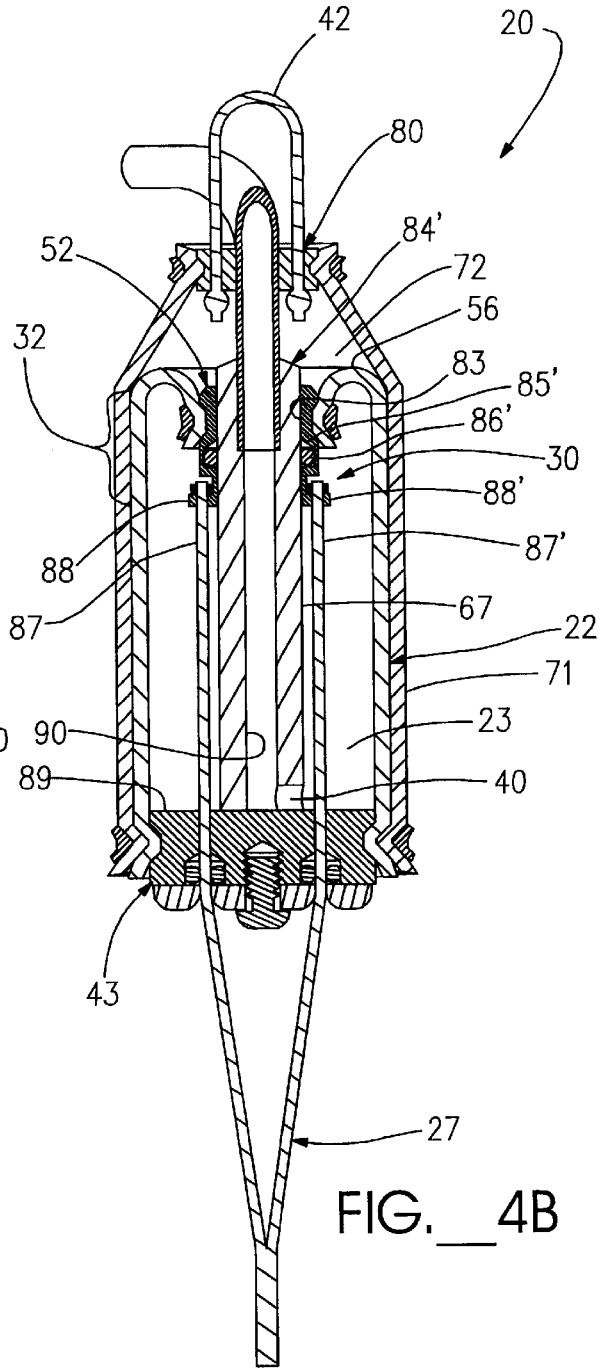
FIG.__4B

ARTIFICIAL MUSCLE ACTUATOR ASSEMBLY

TECHNICAL FIELD

The present invention relates, generally, to actuator assemblies and, more particularly, relates to flexible artificial muscle actuator assemblies.

BACKGROUND ART

In the recent past, industrial robotic devices have played an increasing and more pivotal role in the manufacture of commercial products. These robotic actuator devices can typically be classified into either linear-type actuators or rotary-type actuators, both of which are generally constructed as rigid mechanical structures generating substantial forces and/or torque. These industrial devices, however, are often not suitable for use in biorobotics due to their non-natural compliance of robotic movement, as compared to natural human movement.

Biorobotic actuator devices which have been found suitable for use with, or as a replacement of, biological musculo-skeletal anatomies often include rigid skeletal structures moved by flexible artificial muscle actuators constructed to mimic the form and function of the biological components of real animals or humans. The artificial muscle, therefore, must be designed to function even when laterally deformed, and to include exceptional volumetric efficiency for the amount of linear displacement produced.

Rotary-type actuators, which transmits energy by applying a torque to a shaft rotating about a longitudinal axis thereof, are typically difficult to incorporate as artificial muscle replacements. The electric motors employed necessitate the application of additional conversion mechanisms to convert rotary motion into useable linear motion. These conversion mechanisms, such as linkages, cams, gears, pulleys, etc., become very cumbersome to arrange when attempting to apply these actuators to prosthetic devices which often require that many actuators fit into a small deformable volume while maintaining the high volumetric functional efficiencies of biological musculo-skeletal systems. One such patented system, however, is disclosed in U.S. Pat. No. 4,843,921 to Kremer.

Hydraulic cylinder actuators, by comparison, may be better adapted to mimic biological muscle since both generate a linear force and thus a linear motion. Generally, the outward pressure urged outwardly upon on the cylinder walls is converted into an axial force urging the piston into or out of the chamber. One substantial problem associated with hydraulic cylinders is that they must be substantially rigid since a fluid tight seal must be formed between the cylinder walls and the opposed surface of the inner piston. These small clearances, however, are difficult to maintain for flexible materials. Therefore, conventional hydraulic cylinders are usually substantially rigid structures which oppose substantial deformation and thus lack pliability of biological muscles. Compared to real muscle tissue which can and does operate when laterally deformed, the rigid physical property of hydraulic cylinder actuators limit their application in duplicating biological anatomy.

To address these deficiencies, several artificial muscle assemblies have been developed in the recent past which produce linear displacement and are flexible in nature. The most well renown is the McKibben Artificial Muscle, developed by Dr. Joseph McKibben, in the 1950's for use in an arm prosthesis. Briefly, this design employs an elongated, expandable inner bladder positioned inside a larger diameter braided or woven tube having strategically oriented fiber filaments. This woven tube arrangement enables a controlled radial expansion of the expandable bladder, when pressurized, which causes the opposed ends to axially contract. Thus, the overall longitudinal dimension of the artificial muscle contracts to produce the linear displacement relative the opposed ends of the inner bladder and woven tube.

The primary problem associated with this design is that the bladder and tube combination is only capable of contracting about thirty (30) percent of its rest length. This relatively small linear displacement substantially limits its use in biomechanical systems since the joint dimensions, as well as the tendon attachment and routing, become very critical. In addition to substandard joint geometry and/or tendon routing, other factors may substantially affect the range of motion of the joint such as tendon stretching and mechanical wear. Typical of the basic McKibben artificial muscle design is disclosed in U.S. Pat. Nos. 5,474,485 to Smrt; 5,351,602 to Monroe; 5,185,932 and 5,021,064 to Caines; and 4,739,692 to Wassam et al.

Finally, hydrogels (pH muscles) are also presently being developed as a means for artificial muscle. These hydrogel muscles have several characteristics similar to human muscle, and may change in volume by as much as 1000% when the pH is altered. The present designs, however, are relatively slow to operate and currently produce much smaller linear forces than would be operationally feasible. Moreover, hydrogel muscles are acid based which increases the difficulty in handling, transport and operation.

DISCLOSURE OF INVENTION

Accordingly, it is an object of the present invention to provide an artificial muscle actuator assembly which is substantially flexible.

Another object of the present invention is to provide an artificial muscle actuator assembly which mimics the form and function of a biological muscle component.

Yet another object of the present invention is to provide an artificial muscle actuator assembly which is capable of cooperating with a plurality of like actuator assembly to function as a single unit.

Still another object of the present invention is to provide an artificial muscle actuator assembly which provides increased linear displacement.

Yet a further object of the present invention is to provide an artificial muscle actuator assembly which is capable of operation while being subjected to substantial deformation.

Another object of the present invention is to provide an artificial muscle actuator assembly which provides exceptional volumetric efficiency relative the linear displacement produced.

Still a further object of the present invention is to provide an artificial muscle actuator assembly which is durable, compact, easy to maintain, has a minimum number of components, is cost effective to manufacture, and is easy to operate by moderately skilled personnel.

In accordance with the foregoing objects, a flexible actuator assembly is provided primarily for use as an artificial muscle for robotics, prosthetics or the like. The flexible actuator assembly includes a flexible bladder device providing an expandable sealed chamber between a proximal portion and an opposite distal portion thereof. The bladder device is adapted to substantially directionally displace between a deflated condition and an inflated condition, displacing the proximal portion away from the distal portion. An elongated tendon member is further provided having a distal portion and a spaced-apart anchor portion. The tendon distal portion is oriented outside the chamber, while the anchor portion extends into the chamber through a distal opening in the bladder device positioned proximate the bladder proximal distal thereof. The tendon anchor portion is further coupled proximate to the bladder proximal portion in a manner adapted to: selectively invert displaceable portions of the bladder device when urged toward the deflated condition to position the anchor portion and the bladder proximal portion relatively closer to the bladder distal portion; and selectively evert the inverted displaceable portions of the bladder device when displaced toward the inflated condition. This arrangement positions the anchor portion and the bladder proximal portion relatively farther away from the bladder distal portion for selective movement of the tendon distal portion between an extended condition and a retracted condition, respectively. A sliding seal is formed in the bladder distal opening between the bladder device and the tendon member to sufficiently seal the chamber during reciprocating movement between the extended condition and the retracted condition.

A securing device is mounted to the bladder device for tensile support thereto for proximal attachment of the actuator assembly. This securing device is preferably a sheath member formed to cooperate with the bladder device to substantially constrain radial expansion of the chamber during displacement of the bladder device from the deflated condition to the inflated condition. This sheath member substantially surrounds the bladder device and defines a cavity at a proximal portion thereof formed for receipt of the displacing bladder device when everted toward the inflated condition.

A pressure port extends into the chamber to enable fluid communication for inflation and deflation of the chamber to displace the bladder device between the inflated condition and deflated condition, respectively. The flexible actuator assembly of the present invention further includes a substantially rigid spool positioned in the bladder proximal opening and adapted to cooperate with the bladder distal portion to hermetically seal the chamber. The spool further provides an aperture extending therethrough for reciprocating receipt of the tendon member between the extended condition and the retracted condition.

A support plug is positioned between the bladder device and the tendon anchor portion to mount the tendon member to the bladder device proximate the bladder proximal portion. The proximal portion of the bladder device defines a proximal opening into the chamber formed and dimensioned for receipt of the support plug therein. Further, a proximal edge of the bladder proximal portion is inverted inwardly into the chamber which cooperates with a mounting surface of the support plug to form a hermetic seal therewith. This configuration facilitates inversion and eversion of the bladder device as the support plug is urged back and forth by the tendon member and the bladder during reciprocation between the retracted and extended conditions.

The support plug further provides an elongated support surface extending proximally away from the mounting surface, and formed to provide radial support to the inverted displaceable portions of the bladder device when inverted toward the deflated condition. By providing support to the inverted bladder portion, the amount of compression strain on the bladder is limited to avoid buckling of the bladder in the region of the inverted section. This prevents kinks and cusps from forming as the bladder folds back into itself. Kinks and cusps have the potential to accelerate failure of the fluid tight integrity of the bladder.

The distal portion of the flexible bladder device is further adapted to substantially directionally displace between the deflated condition and the inflated condition which displaces the distal portion away from the proximal portion of the bladder device. An elongated ligament member is included having a proximal portion, oriented outside the chamber, and an anchor portion, spaced-apart from the ligament proximal portion. The anchor portion extends into the chamber through a proximal opening in the bladder device positioned proximate the bladder proximal portion thereof. The ligament anchor portion is coupled proximate to the bladder distal portion in a manner adapted to: selectively invert foldable portions of the bladder distal portion when displaced toward the deflated condition to position the ligament anchor portion and the bladder distal portion relatively closer to the bladder proximal portion; and selectively evert the inverted foldable portions of the bladder distal portion when displaced toward the inflated condition to position the anchor portion and the bladder distal portion relatively farther away from the bladder proximal portion. In turn, the ligament member can be selectively moved between a lengthened condition and a shortened condition, respectively. A second sliding seal is formed in the bladder proximal opening between the bladder device and the ligament member to sufficiently seal the chamber during reciprocating movement between the lengthened condition and the shortened condition.

A central support ring is positioned proximate and coupled to a central portion of the bladder device for structural support thereof. This ring may bisect the bladder device into two individual, independently operable bladders, each of which controls a tendon or ligament. The central support ring includes a pressure port extending into the chamber to enable fluid communication for inflation and deflation of the chamber to displace the displaceable portions between the inflated condition and deflated condition, respectively, and displace the folded portions between the inflated condition and deflated condition, respectively.

Preferably, both a proximal support plug and a distal support plug are provided. The proximal support plug is positioned between the proximal portion of the bladder device and the tendon anchor portion to mount the tendon member to the bladder proximal portion. Similarly, the distal support plug positioned between the distal portion of the bladder device and the ligament anchor portion to mount the ligament member to the bladder distal portion.

Both support plugs define a respective proximal and distal mounting surface adapted to cooperate with the respective inverted engaging surfaces of the bladder proximal portion to form a sufficient seal therewith. Each support plug further defines an elongated proximal support surface extending proximally away from the respective mounting surface of the bladder, and each is formed to provide radial support to the inverted displaceable portions of the bladder proximal portion when oriented toward the deflated condition.

In another aspect of the present invention, a robotic assembly is provided including a robotic device having a first arm and a second arm movably coupled to the first arm for articulation between a first position and a second position. An artificial muscle assembly is coupled between the first arm and the second arm for selective movement between the first and second positions. The muscle assembly includes a flexible bladder device defining, an expandable sealed chamber adapted to substantially directionally displace between a deflated condition and an inflated condition, displacing a bladder proximal portion of the bladder device away from an opposite bladder distal portion thereof. A tensile member cooperates with the bladder device to carry loads from the bladder to the proximal attachment and/or substantially constrain radial expansion of the chamber during displacement of the bladder device from the deflated condition to the inflated condition. The constraining structure includes a structure proximal portion coupled to the first arm and a structure distal portion coupled to the bladder distal portion. The robotic device further includes an elongated tendon member extending through a distal opening into the chamber of the bladder device, and having a tendon distal portion and an anchor portion. The tendon distal portion is oriented outside the chamber and coupled to the second arm, while the anchor portion is coupled to the bladder proximal portion in a manner adapted to: selectively invert displaceable portions of the bladder device when displaced toward the deflated condition to position the anchor portion and the bladder proximal portion relatively closer to the bladder distal portion; and selectively evert the inverted displaceable portions of the bladder device when displaced toward the inflated condition to position the anchor portion and the bladder proximal portion relatively farther away from the bladder distal portion. The tendon distal portion may then be selectively moved between an extended condition and a retracted condition, respectively, which articulates the second arm between the first position and the second position relative the first arm. Finally, a sliding seal is formed in the bladder distal opening between the bladder device and the tendon member to sufficiently seal the chamber during reciprocating movement between the extended condition and the retracted condition.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

FIG. 1 is top perspective view of robotic device incorporating a flexible actuator assembly constructed in accordance with the present invention.

FIGS. 2A and 2B is a sequence of enlarged side elevation views, in cross-section, of the flexible actuator assembly of FIG. 1 illustrating movement of a flexible bladder device and attached tendon member from a deflated condition and extended condition (FIG. 2A), respectively, to an inflated condition and retracted condition (FIG. 2B), respectively.

FIG. 2C is an end plan view of the flexible actuator assembly of FIG. 2B.

FIGS. 3A and 3B is a sequence of side elevation views, in cross-section, of an alternative embodiment of the flexible actuator assembly of FIGS. 2A and 2B having a support plug slideably coupled to a pressure port post.

FIGS. 4A and 4B is a sequence of side elevation views, in cross-section, of an alternative embodiment of the flexible actuator assembly of FIGS. 3A and 3B having the bladder proximal portion slideably coupled to a pressure port post.

BEST MODE OF CARRYING OUT THE INVENTION

Figure 5A:
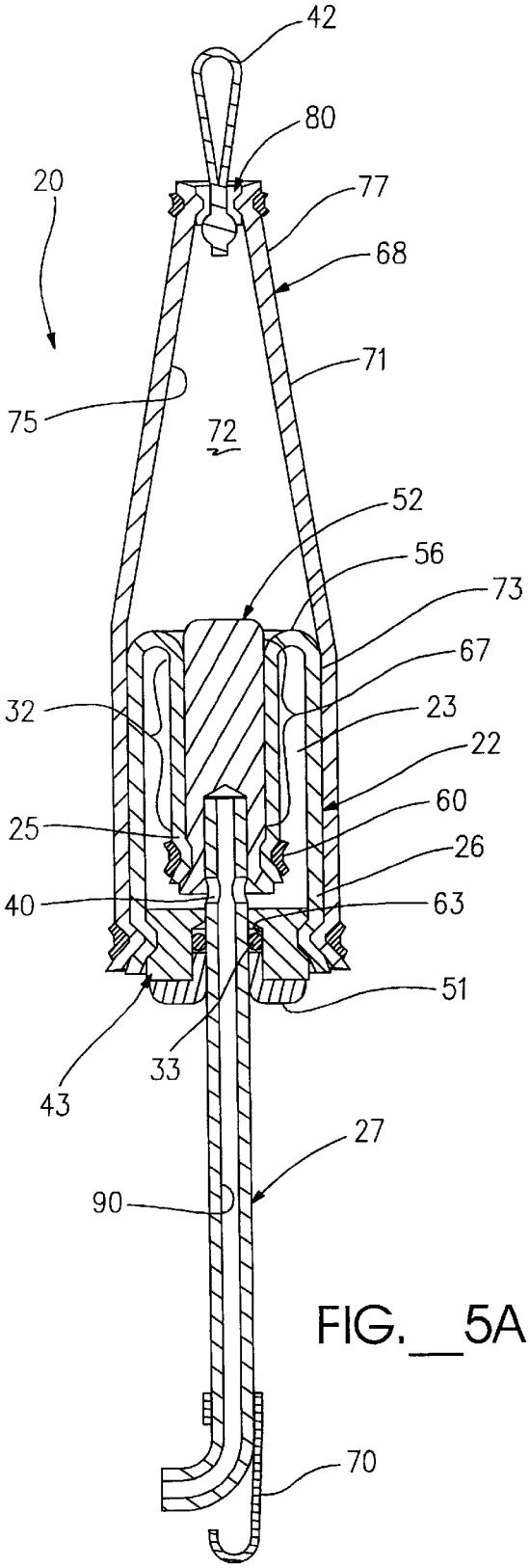
FIGS. 5A and 5B is a sequence of side elevation views, in cross-section, of an alternative embodiment of the flexible actuator assembly of FIGS. 2A and 2B illustrating a hollow tendon member having a passageway in fluid communication with the bladder chamber.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Attention is now directed to FIGS. 1 and 2 where a flexible actuator assembly, generally designated 20, is provided preferably to facilitate movement of a robotic device 21 (FIG. 1). The flexible actuator assembly 20 includes a flexible bladder device, generally designated 22, providing an expandable chamber 23 between a proximal portion 25 and an opposite distal portion 26 thereof. The bladder device 22 is adapted to substantially directionally displace between a deflated condition (FIG. 2A) and an inflated condition (FIG. 2B), displacing the proximal portion 25 away from the distal portion 26 of the bladder device 22. An elongated tendon member, generally designated 27, is further provided having a distal portion 28 and a spaced-apart anchor portion 30. The tendon distal portion 28 is oriented outside the chamber 23, while the anchor portion 30 extends into the chamber through a distal opening 31 in the bladder device 22 positioned proximate the bladder distal portion 26 thereof. The tendon anchor portion 30 is further coupled proximate to the bladder proximal portion 25 in a manner adapted to: selectively invert displaceable portions 32 of the bladder device 22, when urged toward the deflated condition to position the anchor portion 30 and the bladder proximal portion 25 relatively closer to the bladder distal portion 26; and selectively evert the inverted displaceable portions of the bladder device when displaced toward the inflated condition. This arrangement positions the anchor portion 30 and the bladder proximal portion 25 relatively farther away from the bladder distal portion 26 for selective movement of the tendon member 27 between an extended condition (FIG. 2A) and a retracted condition (FIG. 2B), respectively. A sliding seal, generally designated 33, is formed in the bladder distal opening 31 between the bladder device 22 and the tendon member 27 to sufficiently seal the chamber 23 during reciprocating movement between the extended condition and the retracted condition.

Accordingly, a flexible artificial muscle actuator assembly is provided having a bladder device coupled to a tendon member which, upon inflation of the bladder device, retracts the tendon member into the chamber of the bladder device causing substantial linear displacement of the tendon proximal end. Unlike the current flexible McKibben-type artificial muscles employed which provide linear displacement in the range of about 20% to about 35% of its rest length, the flexible artificial muscle actuator device of the present invention is capable of linear displacement in the range of about 40% to about 50% of its rest length, and even up to about 60%, as will be discussed in greater detail below. For example, an actuator assembly ten (10) inches long not including the distal portion of the tendon and the proximal attachment loop may produce tendon travel between about four (4) inches to about six (6) inches, depending on the specific embodiment.

More specifically, the present invention relates to a flexible actuator which upon pressurization with a fluid, shortens in axial length and expands in the transverse cross-sectional dimension similar to a biological skeletal muscle. The present invention transforms energy by controlling the direction of forces produced by the pressurized fluid (either gas or liquid). Such directional control of the pressurized fluid enables: efficient performance even when laterally deformed; contraction of the actuator in a manner similar to real biological skeletal muscle; exceptional tendon displacement from relatively small actuator assembly; and the ability to house many actuators in a relatively small volume without little regard for mechanical interference. Thus, this arrangement is suitable for use in robotics and prosthetics, or the like, having rigid skeletal structures actuated by flexible artificial muscle actuators constructed to mimic the form and function of biological musculo-skeletal anatomies of animals or humans.

For example, a robotic assembly 35 is shown in FIGS. 1A and 1B which incorporates a plurality of flexible actuator assemblies 20, 20' of the present invention adapted for actuation thereof. The robotic assembly 35 includes a robotic device 21 having a first arm 36 and a second arm 37 movably coupled to the first arm through joint 38 for articulation between a first position (FIG. 1A) and a second position (FIG. 1B). At least one artificial muscle assembly (i.e., a first flexible actuator assembly 20) is provided is coupled between the first arm 36 and the second arm 37 on one side of the first arm 36 for selective movement of the second arm 37 from the first position (FIG. 1A) to the second position (FIG. 1A), while at least one opposing artificial muscle assembly (i.e., a second flexible actuator assembly 20') is coupled therebetween on an opposite side of the first arm 36 for selective movement of the second arm 37 from the second position (FIG. 1B) to the first position (FIG. 1A). For each actuator assembly 20, 20', the proximal ends thereof are coupled to the first arm 36 while the distal portions 28, 28' of the corresponding tendon members 27, 27' are coupled to the second arm 37, on opposite sides of the first arm, to enable reciprocating motion of the robotic device 21. Since the artificial muscle assembly of the present invention can only selectively retract the tendon inwardly, an external force must be provided to extend the tendon outwardly. For instance, an opposed artificial muscle assembly, a spring, gravity, an actuator and/or linkage may be employed which produces the desired extension displacement.

As will be discussed in greater detail below, when the inner bladder device of the first actuator assembly 20 is inflated, the tendon member 27 will be retracted into the respective chamber 23 which urges and articulates the second arm 37 about the joint 38 from the second position (FIG. 1B) to the first position (FIG. 1A), relative the first arm 36. In contrast, when the first actuator assembly 20 is deflated and the second actuator assembly 20' is pressurized, the corresponding tendon member 27' is caused to retract which articulates the second arm 37 about the joint 38 from the first position (FIG. 1A) back to the second position (FIG. 1B).

The flexible actuator assembly of the present invention may be applied to any robotic or prosthetic device to actuate jointed, articulating arms. One or more actuator assemblies may also be employed in parallel or in series which function to accumulate the forces acting upon the robotic device. In addition, the tendon may be arranged to act on two or more joints such as in a human finger where a single tendon acts on the entire kinetic chain having several arm members and joints.

Referring back to FIG. 2A, the bladder device 22 is shown in the deflated condition while the tendon member 27, mounted to the bladder proximal portion 25, is shown in an extended condition. A pressure port 40 is provided for fluid communication between the chamber 23 and a pressure source (not shown) capable of providing a positive pressure to chamber 23. Subsequently, the flexible bladder device may be selectively inflated towards the inflated condition as shown in FIG. 2B. The tensile force produced at the tendon is approximately one-half the product of the internal pressure and cross sectional area of the bladder in the region of the bladder transitioning from the inverted condition to the everted condition assuming the diameter of the support plug is very small. The factor of one half results from the pressure forces being shared by the inner (inverted) and outer (everted) portions of the bladder. Since the virtual work of the inflating fluid (pressure integrated over the change in volume) is equal to the work of the tendon (force integrated over the change in tendon travel), the change in volume of the bladder is half that expected of a conventional hydraulic cylinder for the same diameter device and travel, and the corresponding tendon tension is also half. This is one aspect which contributes to the very high volumetric efficiency of the device. For example, for a pressure of about 100 psi, a conventional hydraulic cylinder of one square inch cross sectional area would produce a force of about 100 lbf. The present invention, however, would produce a force of about 50 lbf for the same cross sectional area, but only requires one-half the volume of fluid to produce the same travel length. The pulling force acting on the tendon member, thus, is substantially proportioned to the applied chamber pressure and the transverse cross-sectional area of the bladder device. It will be appreciated that higher and lower pressures may be accommodated by the bladder device depending upon the bladder construction and the pressure source without departing from the true spirit and nature of the present invention.

The bladder device 22 is preferably substantially elongated in shape and adapted to be linearly displaced along the longitudinal axis of the bladder device. Accordingly, as the bladder device expands along the direction of arrow 41, the tendon member 27 is urged from the extended condition (FIG. 2A) toward the retracted condition (FIG. 2B) to produce a substantially similar linear displacement as that of the bladder device. Unlike the prior art flexible actuator assembly, the present invention enables substantial linear displacement of the tendon member 27 from at least 40% to about 50% of its rest length. Depending upon the longitudinal length dimension of the bladder device, the eversion of the inverted displaceable portions 32 of the bladder device may be by as much as about ½ the rest length dimension of the bladder device. Thus, by affixing the tendon proximal end to the bladder proximal portion 25, the displacement of the tendon distal end will be substantially the same as the linear displacement of the bladder proximal portion 25 during eversion of the inverted displaceable portions 32 of the bladder device.

The bladder device 22 is preferably provided by a fluid-tight flexible tubular structure capable of withstanding substantial internal pressures. A fiber material supports the majority of the stress induced in the bladder by the internal pressure, while an elastomeric material seals the bladder to contain the fluid. Moreover, the bladder device 22 must be sufficiently flexible to enable the displaceable portions 32 to properly invert and evert, while maintaining sufficient stiffness to prevent buckling of the distal bladder region during deflated inversion. The bladder must also be capable of stretching to accommodate a range of circumferences by: arranging the fibers angularly to the tendon axis; or using fibers which can stretch; weaving or knitting the fibers into a cloth-like material that due to the weave geometry can stretch. In addition it is desirable that the bladder stretch circumferentially but not axially. Preferably, the tubular structure is composed of flexible fiber materials such as KEVLAR®, nylon, DACRON®, cotton, polyester, hemp, etc., embedded in or bonded to a flexible bladder composed of a flexible elastomeric material such as, latex, polyurethane, silicone, etc. The fibers may be: woven into a tube; woven into flat sheets which are wrapped in a spiral with over-lapping regions to form a tubular shape; positioned in spiraling layers of adjacent aligned fibers lying substantially parallel to each other such as commonly used in filament wound structures, consisting of two or more layers. The fibers are arranged in such a way that they produce almost zero net torque about the axis of the device when supporting a load. More preferably, as will be discussed below, the bladder device is provided by a woven aramid (KEVLAR®) fiber tube such as the Expando KV line provided by Bentley Harris, which is vacuum impregnated with a polyurethane rubber such as PMC 121/50 provided by Smooth On Inc.

The tendon member 27 may be provided by any elongated structure sufficiently strong to transfer axial forces between the bladder device and the articulating external structure upon which the distal end of the tendon member is attached. An attachment device 70 may be included along the tendon member 27 to facilitate attachment to the external structure, as shown in FIG. 1, while the tendon anchor portion 30 (FIG. 2) is adapted to mount the tendon member 27 to the bladder proximal portion 25 of the bladder device 22. Preferably, the tendon member 27 is provided by a single monofilament fiber such as Big Game Leader 300 lb fishing leader available from Maxima MFG. Co. Meinel GmbH., or by a central fiber core such as aramid (KEVLAR®), available from E. I. du Pont de Nemours & Co., Inc., surrounded by an outer elastomer or polymer membrane or with heat shrinkable PTFE/FEP tubing, such as that available from TexLoc, LTD, having a FEP shrink melt liner which melts and bonds to the tendon fibers. It will be understood, however, that any laterally flexible, or semi-rigid or rigid material having relatively strong axial properties may be employed such as wires, fiber cords, nylons, plastics, DACRON®, monofilament fishing line, KEVLAR® reinforced polyurethane, PTFE (TEFLON®), composites of fibers and natural or synthetic elastomers and or polymers.

The bladder distal opening 31 is preferably circular (FIG. 2C) in cross-sectional dimension and is defined by the distal edge of the bladder device. To seal the chamber 23 from the exterior environment, a pressure spool 43 is disposed in the bladder distal opening and is sized and dimensioned to snugly cooperate with an interior wall 45 of the bladder distal portion 26 to form a seal therewith. The distal pressure spool 43 also is substantially cylindrical-shaped and includes an annular slot 46 extending circumferentially about the spool to facilitate load bearing capability and seal formation with the bladder interior wall 45. A mating annular-shaped distal crimp device 47 cooperates with the annular slot 46 to urge the distal portion 26 of the bladder device 22 into seal engaging contact with the annular slot 46 to form a seal therewith. Any conventional seal arrangement, however, may be employed such as the techniques disclosed in U.S. Pat. No. 5,014,600 to Krauter et al., incorporated herein by reference in its entirety. The bladder may also be chemically bonded to the pressure spool 43.

The distal crimp device can be comprised of a metallic material, which is deformed to apply radial compression, or twine secured in place with a knot, such as a clove hitch and/or over hand knots. Preferably, the twine is a material such as nylon, which when applied under tension, maintains a radial inward pressure.

The distal pressure spool 43 includes a tendon aperture 48 extending axially therethrough into chamber 23 which is formed for reciprocating receipt of the tendon member therein. Preferably, the tendon aperture 48 includes a distal seal recess 50 facing towards or away from chamber 23 which is sized to accommodate the sliding seal 33 therein to slidingly seal the chamber from the exterior environment outside the bladder device. The sliding seal may be provided by any conventional seal device such as an 0-ring, or a combination of sealing devices and support structures such as backing rings and washers, and is preferably composed of, nitrile, butyl, epichorohydrin, ethylene-propylene, polyurethane, styrene butadiene. A distal seal retainer 51 is provided to retain the sliding seal 33 in the distal seal recess 50. Lubrication may also be included to facilitate sliding of the tendon member between the retracted condition and the extended condition. As best viewed in FIGS. 2A and 2B, the distal pressure spool may include pressure port 40 which enables fluid communication with the pressure source (not shown).

Briefly, while all the fluid seals mentioned herein between the components are preferably hermetic in nature, it will be understood that these fluid seals need not be completely hermetic as long as they are "sufficient" to enable the pressure source to generate a sufficient positive pressure in the chamber 23 so that the bladder device 22 may be moved from the deflated condition to the inflated condition. Accordingly, there may be some leakage or even intentional controlled leakage in one or all of the seals so that deflation of the inflated bladder device may be automatically performed in some instances.

In the preferred embodiment, a support plug, generally designated 52, is positioned between the bladder device 22 and the tendon anchor portion 30 to mount the tendon member 27 to the bladder device 22 proximate the bladder proximal portion 25. FIG. 2 illustrates that proximal portion 25 of the bladder device 22 defines a proximal opening 53 into the chamber formed and dimensioned for snug receipt of the support plug therein. The bladder proximal opening 53 is preferably circular in cross-section and is positioned at the proximal portion 32 of the bladder device 22.

To facilitate inversion and eversion of the displaceable portions 32 of the bladder device 22 during inflation and deflation thereof, the proximal edge 55 of the bladder proximal portion 25 is inverted radially inward toward and into the chamber 23. This configuration facilitates inversion and eversion of the displaceable portions 32 of bladder device 22 as the support plug is urged axially back and forth during reciprocation between the retracted and extended conditions. At the displaceable portion 32 of the bladder device, a circular inversion fold 56 is formed which is caused to be displaced linearly along the longitudinal axis of the bladder chamber 23 between the deflated condition and the inflated condition. As the bladder device 22 is inflated toward the inflated condition, inversion fold 56 is urged in the direction of arrow 41, and away from the bladder distal portion 26. In turn, the support plug 52 is urged away from the distal pressure spool 43. Consequently, portions of tendon member 27 are drawn into chamber 23 toward the retracted condition.

At the inverted bladder proximal portion 25, an engaging surface 57 of the bladder device cooperates with a mounting surface 58 of the support plug 52 to form a seal therewith. Similar to the distal pressure spool 43, the mounting surface 58 is formed as an annular slot extending circumferentially about the support plug 52 to facilitate load bearing capability and seal formation with the inverted engaging surface 57 of the proximal portion 25 of bladder device 22. An annular-shaped, support plug crimp device 60 cooperates with the mounting surface 58 to urge the bladder proximal portion 25 into seal engaging contact with the support plug 52 to form a sufficient seal therewith. The bladder 22 may also be chemically bonded to the support plug 52.

The support plug preferably includes an axially extending passageway 61 having a diameter substantially similar to that of the tendon member 27. This passageway 61 is formed for receipt of the anchor portion 30 of the tendon member 27 therethrough to mount the tendon member to the support plug. The anchor portion 30 is preferably situated at the proximal end of the tendon member and is preferably provided by a stop member 62 having a diameter larger than passageway 61 to prevent movement therethrough.

The support plug 52 includes a proximal seal recess 63 co-axially aligned with passageway 61 and sized to accommodate a proximal seal 65 therein. Proximal seal 65 is preferably provided by an O-ring seal or the like which is adapted to seal the chamber from the exterior environment. Any conventional seal device or combination of devices, however, may be employed. A proximal seal retainer 66 retains the proximal seal 65 in the proximal seal recess 63.

In accordance with the present invention, support plug 52 further provides an elongated, cylindrical-shaped support surface 67 extending axially from the mounting surface 58 and in a direction away from the distal pressure spool 43. This support surface 67 is formed to provide radial support to the inverted displaceable portions 32 of the bladder device 22 during reciprocation between the deflated and inflated conditions. As best viewed in FIG. 2A, when the bladder device 22 and the support plug 52 are oriented in the deflated condition, the inverted displaceable portions 32 are radially supported against the plug support surface 67.

Such radial support is necessary due in-part to the large deformations which may occur at the inversion fold 56 when the displaceable portions 32 of the bladder device are inverted and everted between the deflated an inflated conditions. These deformations include the formation of buckles and/or cusps which may cause excessive and damaging stresses in the bladder during the progression and travel of the bladder device between the inflated and deflated conditions. Depending primarily upon the bladder material composition, the thickness of the bladder material, the inflated chamber diameter and the support plug diameter, the radius of the inversion fold 56 may be calculated and designed in a manner to reduce the prospect of kinking. For example, a smaller radius inversion fold 56 has less tendency to kink since the strain in the material produced by the difference in the circumference of the inverted portion of the bladder adjacent to the support plug relative to the everted portion of the bladder is less. Thus, in this configuration, the support plug diameter may be sized to limit the difference between the inverted and everted circumferences to some maximum value, limiting the radial compressive stress in the inverted bladder in the region adjacent the support plug, which in turn prevents kinking and/or cusp formation.

The tendency for the bladder to buckle is dependent on the material mechanical properties and its thickness. Thus a thicker bladder has less tendency to buckle and form kinks or cusps, but increased thickness presents several other problems such as increased bending stress in the region on the inversion fold 56.

Actuator assemblies having inflated bladder diameters between one-half an inch and one inch diameter, and having a support plug diameters between about ¼ of the inflated chamber diameter to about ¾ of the chamber diameter, and more preferably about ½ of the chamber diameter are capable of accommodating pressures up to 80 psi. By designing controlling the inversion radius of inversion fold 56 to be as large as a particular bladder device can accommodate (i.e., given the chamber diameter, the material thickness and the bladder composition), reliable actuator assemblies can be constructed having good service lives. It is important to note that bladders which can stretch more circumferentially can accommodate a much larger inversion radius and thus require smaller diameter support plugs. An ideal bladder material which could stretch infinitely in the circumference and yet stretch very little axially would require a zero diameter support plug, i.e., no support plug at all.

The axial length dimension of the support surface 67 is preferably configured to support the full length of the inverted displaceable portion in the deflated condition. Hence, this length is preferably about one-half the length of the bladder device.

To move the bladder device from the inflated condition (FIG. 2B) back to the deflated condition (FIG. 2A), and hence, the tendon member from the retracted condition to the extended condition, the pressurized fluid in the inflated chamber 23 may be expelled through pressure port 40 or through an auxiliary deflation port (not shown) in fluid communication with the chamber. In one embodiment, the tendon member 27 may be biased toward the extended condition so that upon deflation of the bladder device, the tendon member 27 will be pulled from the retracted condition to the extended condition. In the configuration of FIG. 1, the opposing flexible actuator assemblies 20, 20' function to move the other assembly, from the retracted condition to the extended condition through the articulation of second arm 37 about joint 38. The tendon member extends pulling the support plug 52 toward the pressure spool 43, inverting the bladder 22.

A securing device, generally designated 68, is included to enable mounting of the bladder device 22 to an independent external structure (e.g., first arm 36). In one aspect, a single or multiple tendon structure, or the like (not shown), may couple the distal pressure spool 43 to the proximal attachment device 42 for mounting to the external structure. One end of the tendon member 27 may be coupled to the pressure spool 43 while the opposite proximal end may be mounted to a proximal attachment device 42. Briefly, it will be understood that while the distal and proximal attachment devices 70 and 42 are illustrated as attachment loops coupled to the distal end of tendon member 27 and at the proximal end of the securing device 68, respectively, any conventional coupling device may be employed to mount the actuator assembly 20 between the articulating independent structures without departing from the true spirit and nature of the present invention. As shown in FIGS. 5 and 6 for example, the proximal attachment device 42 may be in the form of a U-shaped bolt, a flexible U-shaped member, or several flexible members joined together proximally.

In the preferred embodiment, the securing device 68 is provided by a sheath member 71 which functions to couple the proximal attachment device 42 to the bladder device 22, and may further cooperate with the bladder device 22 to substantially constrain the radial expansion of the chamber 23 during displacement of the bladder device from the deflated condition to the inflated condition. As best viewed in FIGS. 1 and 2, this sheath member 71 substantially surrounds the bladder device 22 for enclosure therein. A proximal cavity 72 is thus formed at the proximal portion of the sheath member 71 which is configured for receipt of the displacing bladder device 22 therein when everted toward the inflated condition. The proximal cavity 72 must be sufficiently deep to receive the proximal portion of the support plug 52 when fully extended in the inflated condition (FIG. 2B). In the preferred embodiment, the length dimension of the support plug 52 and the depth dimension of the cavity 72 may cooperate to provide a physical stop for abutting contact of the support plug the fully extended inflated condition. This arrangement prevents adverse over-extension of the bladder device.

By providing constraining radial support about the inflating bladder device, the sheath member functions to guide the bladder giving it radial support. This aspect is important to prevent or reduce bladders, having high aspect ratios (length/diameter), from skewing and/or buckling during inflating under high tendon loads. Radial expansion of the bladder device 22 generally progresses until the bladder device outer walls 73 contact the interior walls 75 of the sheath member 71. Due to the increased resistance in the radial dimension, expansion is more axially directed. Thus, upon expansion from the deflated condition to the inflated condition, eversion of the inverted displaceable portions 32 in the direction along the longitudinal axis of the bladder device is facilitated.

The sheath member 71 may be provided by any material sufficient to promote axial, as well as radial, support. The proximal cavity 72 of the sheath member 71, moreover, need not be sufficiently sealed like the bladder chamber. Therefore, it is not necessary for the composition of the sheath member to be air tight.

Similar to bladder device 22, a distal opening 76 is provided at a distal portion of sheath member 71. Disposed in the sheath distal opening 76 are both the distal pressure spool 43 and the bladder device. FIG. 2 best illustrates that the distal crimp device 47 contacts the outer wall of the sheath member 71, which provides tensile load bearing capability and sealed engaging contact between the distal portion of the bladder device 22 and the annular slot 46 of pressure spool 43. The sheath member may be chemically bonded to the bladder over the entire non-displaceable portion of the bladder.

At the proximal portion 77 of sheath member 71 is a proximal opening 78 which extends into cavity 72. A proximal plug 80 is provided formed and dimensioned for receipt in the sheath proximal opening 78. Proximal plug 80 is preferably cylindrical in shape and includes an annular shaped slot 81 configured to form a seal with the interior wall 75 of the proximal portion of sheath member 71. A proximal crimp device 82 cooperates with the proximal plug annular slot 81 to urge the interior wall 45 of the bladder device into engagement with the proximal plug annular slot 81 for mounting thereto. Since cavity 72 need not be fluid-tight, the seal formed between the proximal plug and the sheath need not be sufficiently sealed or fluid-tight like the bladder device. However, the coupling therebetween must provide adequate tensile strength to accommodate the attachment device 42.

In this arrangement, the proximal plug 80 is of a diameter substantially less than that of the pressure spool 43. Accordingly, the proximal portion 77 of the sheath member 71 tapers radially inward for mounting engagement to the proximal plug. As the bladder device 22 expands radially, the diameter of the cavity 72 of the sheath also expands to a dimension similar to the diameter of the pressure spool. Briefly, this tapered arrangement, as will be illustrated and described below in the embodiment of FIG. 5, enables a more life-like muscle shape for the device, by using less space in the vicinity of the proximal attachment. This feature enables other devices to more easily be attached nearby in applications where space is limited. Moreover, when a tapered bladder is employed, it will conform the taper of the bladder when everted.

Briefly, the pressure spool 43, the support plug 52 and the proximal plug 80 are preferably substantially rigid to enhance seal formation. Such materials include, although are not limited to, acetal (DELRIN®), steel alloys, aluminum alloys, titanium, PTFE (TEFLON®), polymers, fiber reinforced polymers. It will further be understood that semi-rigid elastomeric materials may be employed as well, such as polyurethanes, silicones, composites of fibers and natural or synthetic elastomers and or polymers.

Turning now to FIGS. 3A and 3B, an alternative embodiment of the present invention is illustrated having a flexible actuator assembly 20 incorporating an elongated support post 84 positioned longitudinally into chamber 23. The support plug 52 defines a sliding surface 83 formed for sliding engagement with the support post 84 therealong between the deflated condition (FIG. 3A) and inflated condition (FIG. 3B). This sliding cooperation may provide lateral support to bladder device 22 and further facilitates guided reciprocal, axial movement of the support plug 52 into the sheath cavity 72. The support post 84 is preferably a semi-rigid material such as fiber reinforced nylon, which resists buckling during sliding articulation with the support plug 52, and resists radial expansion due to the internal fluid pressure communicating with chamber 23 for inflation thereof.

Preferably, the sliding surface 83 defines an axially extending orifice sized for sliding support and receipt of the support post 84 therein. Support plug 52 further includes a seal recess 85 formed for receipt of a support plug seal 86 adapted to sufficiently seal chamber 23 from the surrounding environment. Support plug seal 86 is preferably provided by a sealing mechanism such as an O-ring or a combination of sealing devices and support structures such as backing rings and washers, or the like. To further enhance sliding movement, a lubricant may be provided between the support post 84 and the support plug 52.

In the arrangement of FIGS. 3A and 3B, the tendon member 27 may include two or more leg portions 87, 87' having corresponding anchor portions 30, 30' coupled to support plug 52. This configuration operates to even the force distribution along the support plug 52 so the sliding surface 83 slidingly cooperates with the support post 84. The distal portion of support plug 52 may include at least two foot portions 88, 88' formed for coupling to the respective anchor portions 30, 30' of the leg portions 87, 87' of the tendon member 27. Further, at least two apertures 48, 48' are provided which extend axially through pressure spool 43 for sliding receipt of the leg portions 87, 87' of the tendon member 27 therethrough. A pair of seals 33, 33', such as an O-ring or a combination of sealing devices and support structures, such as backing rings and washers or the like, are disposed in the corresponding distal seal recesses 50, 50' for sealed sliding engagement with the tendon member.

Moreover, the support post 84 may be hollow in configuration to provide a communication conduit 90 extending therethrough. This conduit 90 functions as a pressure port 40 for fluid communication with a pressure source (not shown) for inflation of bladder device 22. This pressure port 40 is positioned at the distal end of the support post 84 to enable fluid communication with bladder chamber 23.

For additional lateral support, as best viewed in the embodiments of FIGS. 4A and 4B, support post 84 may have a greater shell thickness. Further, the end of the support post may abut or be affixed to the interior wall 84 of pressure spool 43 for support thereof. In this configuration, the pressure port 40 may extend out of one or more of the sides of the support post 84.

FIGS. 4A and 4B further illustrate an alternative embodiment of the present invention in which the support surface 67, providing radial support of the displaceable portions 32 of the bladder device 22 while in the deflated condition, is provided by the circumferential surface of the support post 84. When the bladder device 22 is oriented in the deflated condition (FIG. 4A), the inverted displaceable portions 32 come to rest in sliding radial support with the support surface 67 of the support post 84. This embodiment is best suited for use with a lubricating working fluid which not only serves to pressurize the bladder but also to lubricate the sliding contact between the bladder and the support tube. In such a system lubricating fluid would be present in the space between the sheath and the bladder/support tube.

Figure 5B:
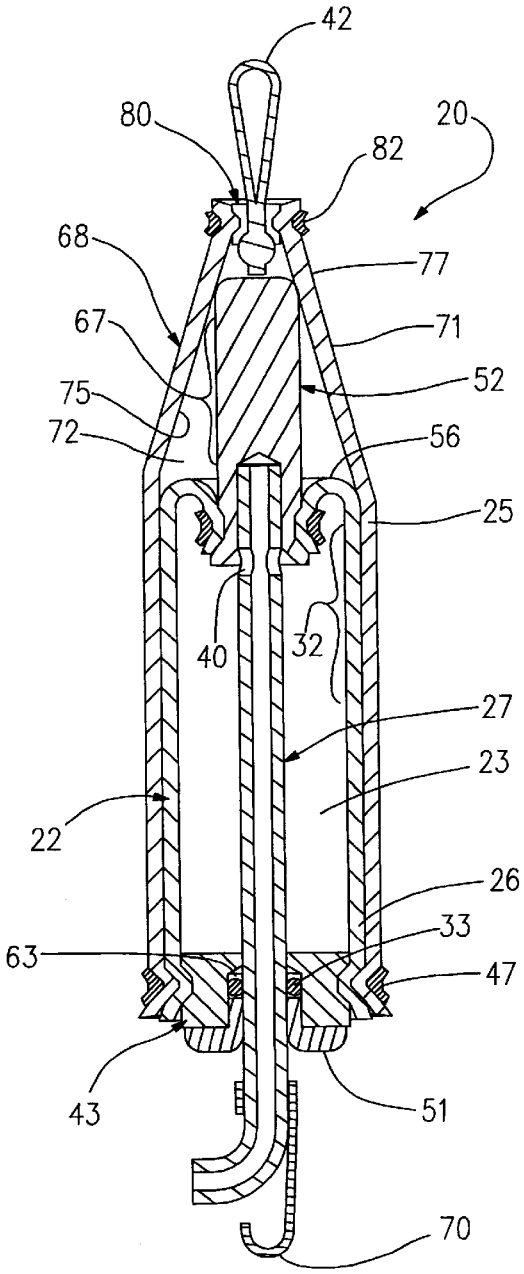

In still another alternative embodiment, the tendon member 27 itself may include a fluid communication conduit 90 extending therethrough. As shown in FIGS. 5A and 5B, one end of the conduit 90 is coupled to a pressure source (not shown) while the opposite end thereof terminates in chamber 23 at pressure port 40. In this configuration, the tendon member 27 must be sufficiently rigid to maintain its integrity during operation so that the bladder device may be properly inflated.

Figure 6A:
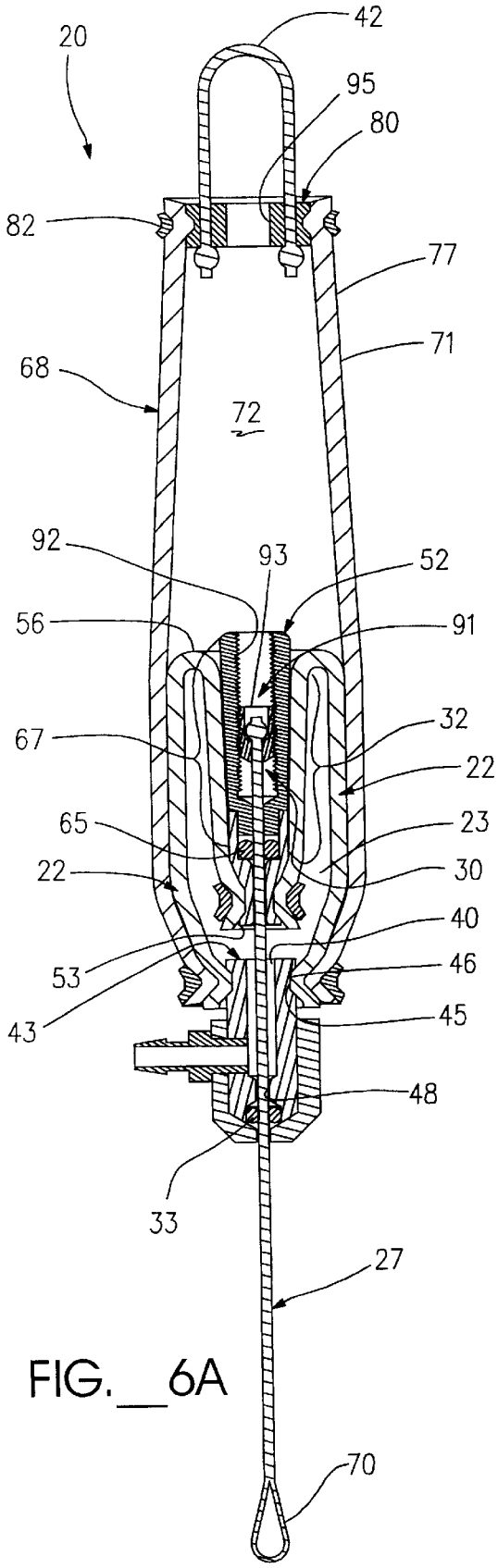
FIGS. 6A and 6B is a sequence of side elevation views, in cross-section, of an alternative embodiment of the flexible actuator assembly of FIGS. 2A and 2B showing a tapered proximal portion of the bladder device.

As set forth above, the diameter of support plug 52 is sized to prevent kinking of the inversion fold 56 during movement from the deflated condition to the inflated condition. Thus, a smaller diameter support plug 52, and corresponding bladder device diameter, is preferable in most instances to increase the inversion fold radius. However, to further reduce stress at the displaceable portions 32 of the bladder device 22 during inversion, FIG. 6A illustrates that the displaceable portion 32 of the bladder device are preferably molded to taper inwardly toward the proximal end. Thus, in the deflated condition, the inverted displaceable portions taper radially inwardly, facilitating the reduction of the circumferential stresses allowing a slightly larger inversion radius of inversion fold 56. It is clear that the tapering the bladder predisposes it to have a smaller rest diameter at the inverted portion adjacent the support plug and larger diameter at the everted bladder region. This predisposition increases the performance of the bladder by: allowing an increased inversion radius of the inversion fold 56; allowing the inverted portion to fit inside the everted portion while reducing possible contact between the respective inner walls of the bladder; reducing the angle through which the bladder material must bend at the inversion radius; reducing the amount of force generated at a given pressure as the bladder eversion increases; and reducing the tendency for the outer walls to buckle during inversion. This last performance increase is especially important for thin flexible bladders such as those having flexible pantyhose-like knit as the reinforcement.

Figure 6B:
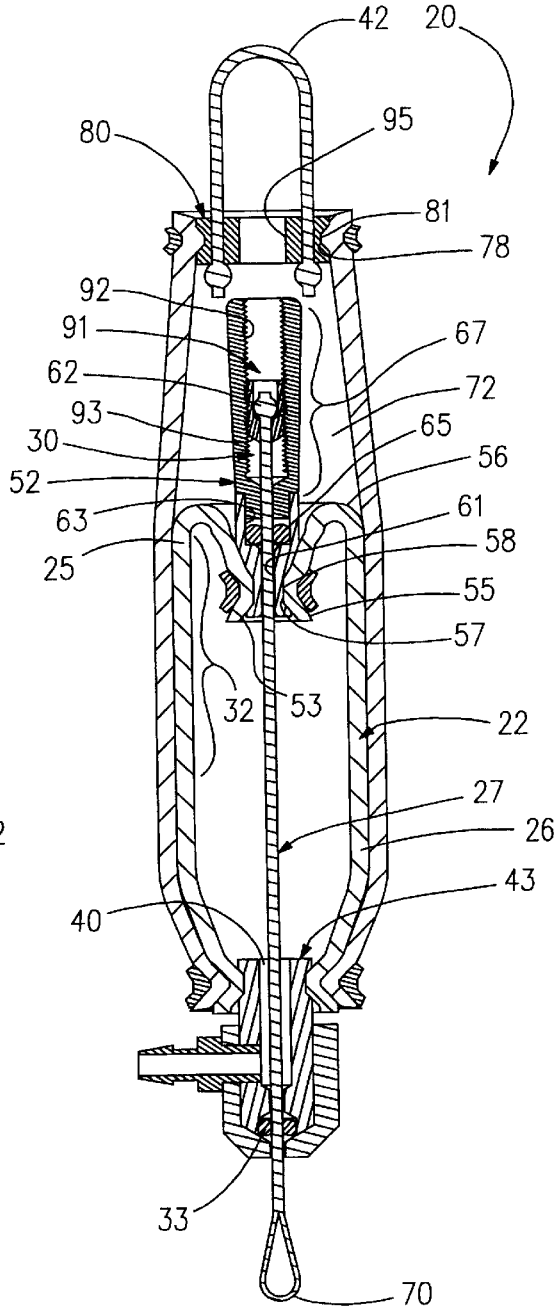

As best viewed in FIG. 6B, to provide sufficient radial support for the inverted displaceable portion 32 in the deflated condition, the support plug 52 also includes a like profile. Thus, the support surface 67 of the support plug 52 tapers outwardly from the distal end to the proximal end thereof at substantially the same slope as the inward taper of the proximal portion 25 of the bladder device.

The embodiment of FIGS. 6A and 6B further include a length adjustment device 91 at the anchor portion 30 of the tendon member 27 which enables length adjustment thereof relative the support plug 52. Extending axially into support plug 52 from the proximal end is a threaded hole 92 formed for threaded receipt of an allen-type screw 93 therein. The tendon stop member 62 is fixedly mounted to screw 93 such that the relative length of the tendon member 27 may be adjusted by rotating the screw in and out of threaded hole 92. The tendon member 27 and the screw 93 provide axial support, while enabling the screw to rotate while the tendon does not. Access to the screw 93 may be provided by an access port 95 extending through the proximal plug 80. This arrangement further enable simple removal and replacement of the tendon member, allowing the tendon to be fed through the access port 95 and then through the passage way 61 and through the tendon aperture 48, without disassembly of the device.

Figure 7:
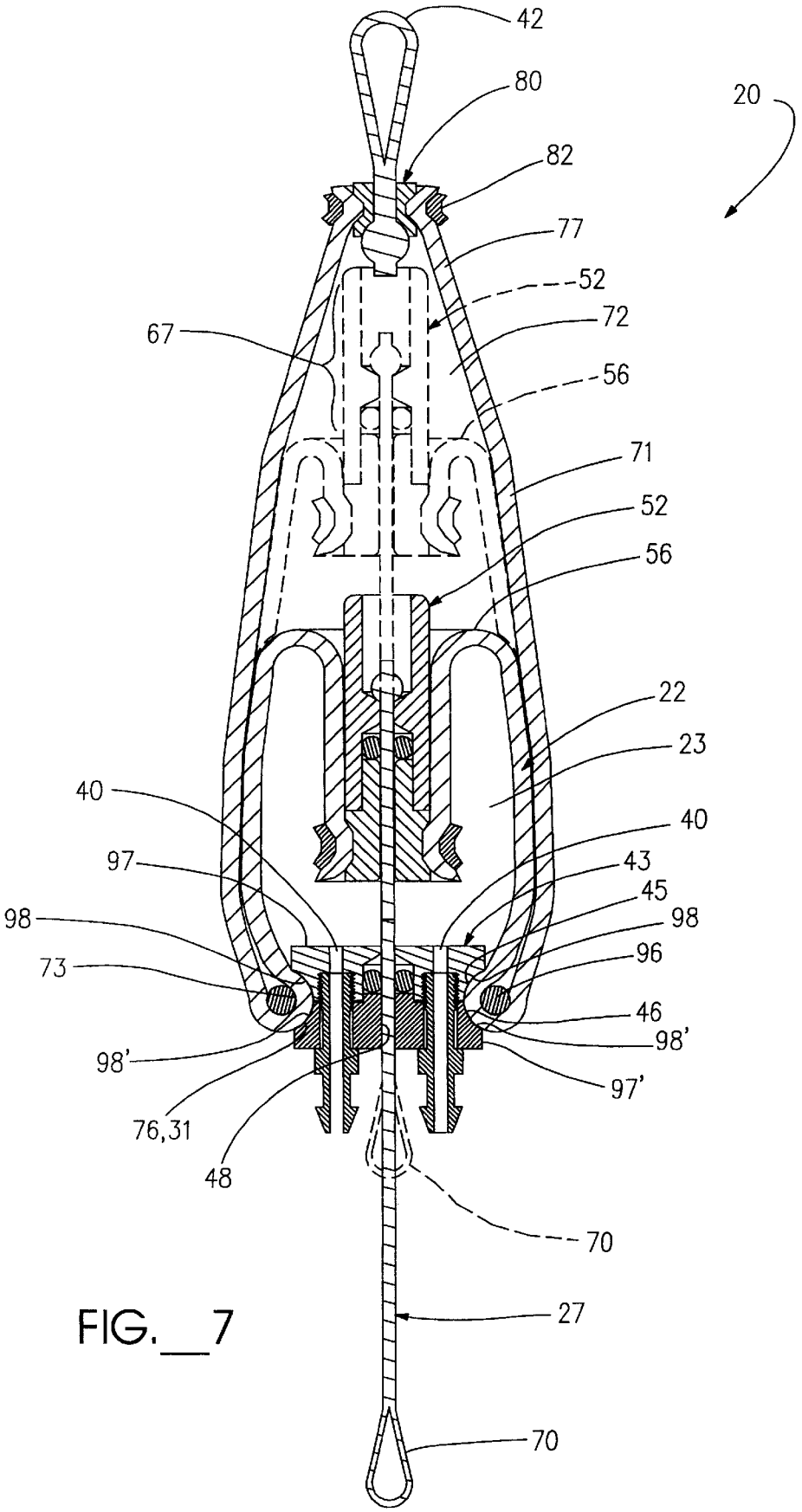
FIG. 7 is a side elevation view, in cross-section, of an alternative embodiment of the flexible actuator assembly of FIGS. 2A and 2B having an integrated, one piece sheath and bladder device.

The flexible bladder device 22 and the corresponding sheath member 71 may further be comprised of a single tubular sleeve structure. As shown in FIG. 7, the bladder device 22 is formed by inverting the distal portion of the sheath member 71 into cavity 72 which reciprocates between the deflated condition (solid lines in FIG. 7) and the inflated condition (broken lines). The circular-shaped distal fold 56 of the tubular sleeve forms the distal opening into bladder chamber 23 which is then sealed by distal pressure spool 43.

A mounting ring or crimp 96 may be positioned between the sheath member 71 and the bladder device 22 at the distal fold 56 to provide integrity to the distal opening 76, 31 and the distal portions of both the sheath member 71 and the bladder device 22. This mounting ring 96 also functions to mount distal portions of the sheath member 71 and the bladder device to the pressure spool 43 for sealed engagement therewith. This ring 96 may be crimped into engagement with the exterior wall 73 of bladder device 22 so that the interior wall 45 thereof is oriented in engaging contact with the annular slot 46 of the pressure spool 43 to sufficiently seal chamber 23 from the environment. It will be appreciated, however, that simultaneous crimping around both the sheath member and the bladder member may occur similar to the previous embodiments, or by affixing a crimp mechanism immediately proximal to the bulge in the sheath formed by the mounting ring 96.

In the embodiment of FIG. 7, the pressure spool 43 may be comprised of two matching spool halves 97 and 97' which cooperate to mount the mounting ring 96 thereto. Each spool half 97, 97' provides an annular slot half 98, 98', combining to form annular slot 46, which mates with the mounting ring to seal the bladder chamber 23. As the two spool halves 97, 97' are affixed together, the mounting ring 96 is drawn therebetween and into engagement with the two opposed annular slot halves 98, 98' for sealed engagement therewith.

Figure 8A:
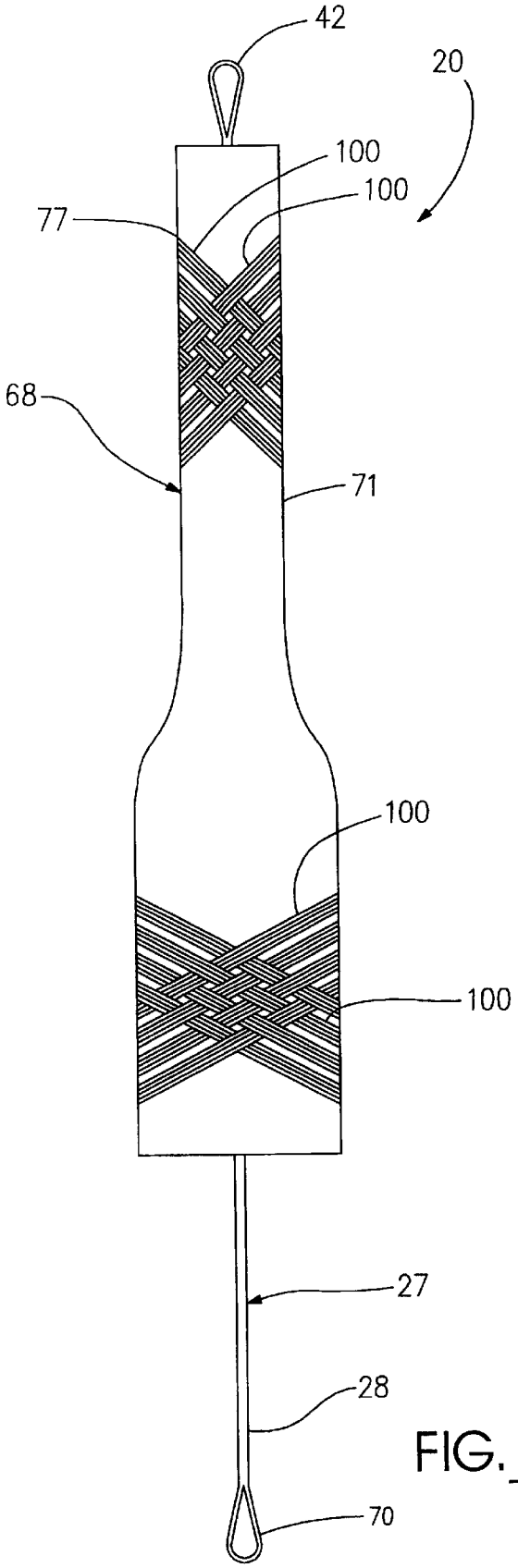
FIGS. 8A and 8B is a sequence of side elevation views of the flexible actuator assembly of FIGS. 2A and 2B having a weaved exterior sheath similar in function to a McKibben artificial muscle.
Figure 8B:
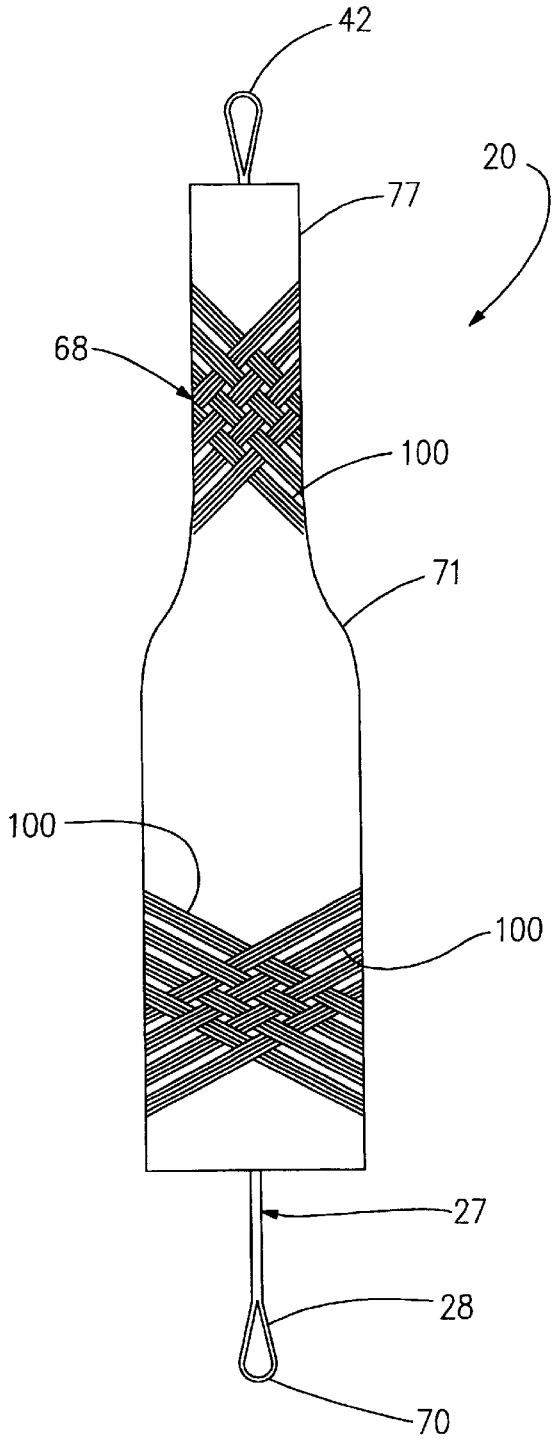

In accordance with the present invention, the flexible actuator assembly 20 may be combined with the contractual properties of the conventional McKibben artificial muscle to provide an even greater linear displacement of the tendon member 27. As is well known in the field, the McKibben design incorporates a braided or woven sleeve, having strategically oriented fiber filaments 100 similar to that shown in FIGS. 8A and 8B, mounted to or integrated with the bladder device. Radial expansion of the expandable bladder is further controlled, when pressurized, in a manner causing the opposed ends to axially contract. Thus, the overall longitudinal dimension of the artificial muscle contracts to produce the linear displacement relative the opposed ends of the inner bladder and woven tube. Accordingly, by combining the contractual linear displacement of the McKibben model with the flexible actuator assembly design of the present invention, linear displacements on the order of up to about 60% of the rest length are attainable. This concept is particularly illustrated in the embodiments of FIGS. 2A and 2B, and in FIGS. 6A and 6B.

Figure 9A:
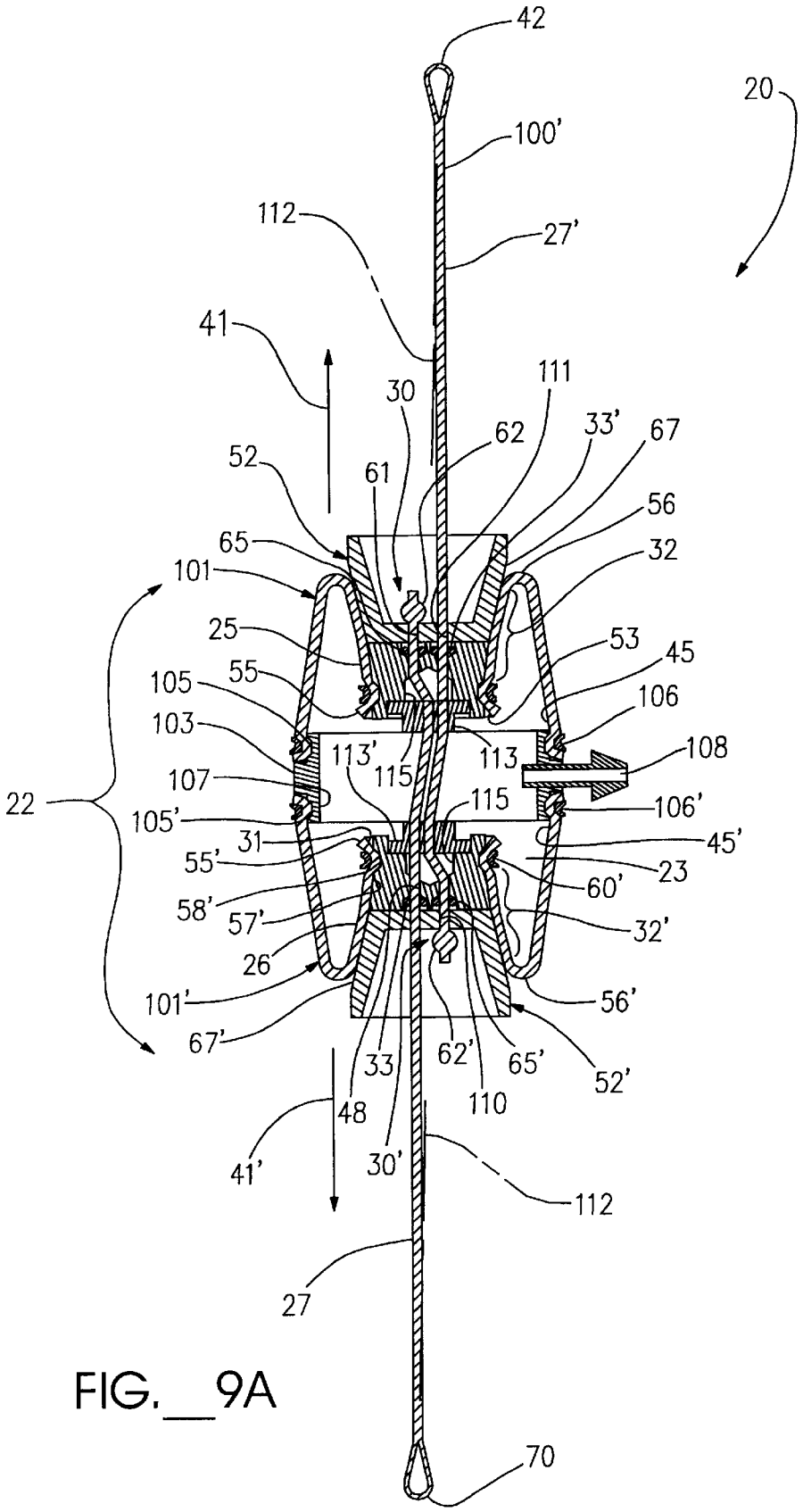
FIGS. 9A and 9B is a sequence of side elevation views, in cross-section, of an alternative embodiment of the flexible actuator assembly of FIGS. 2A and 2B having two opposed bladder devices.
Figure 9B:
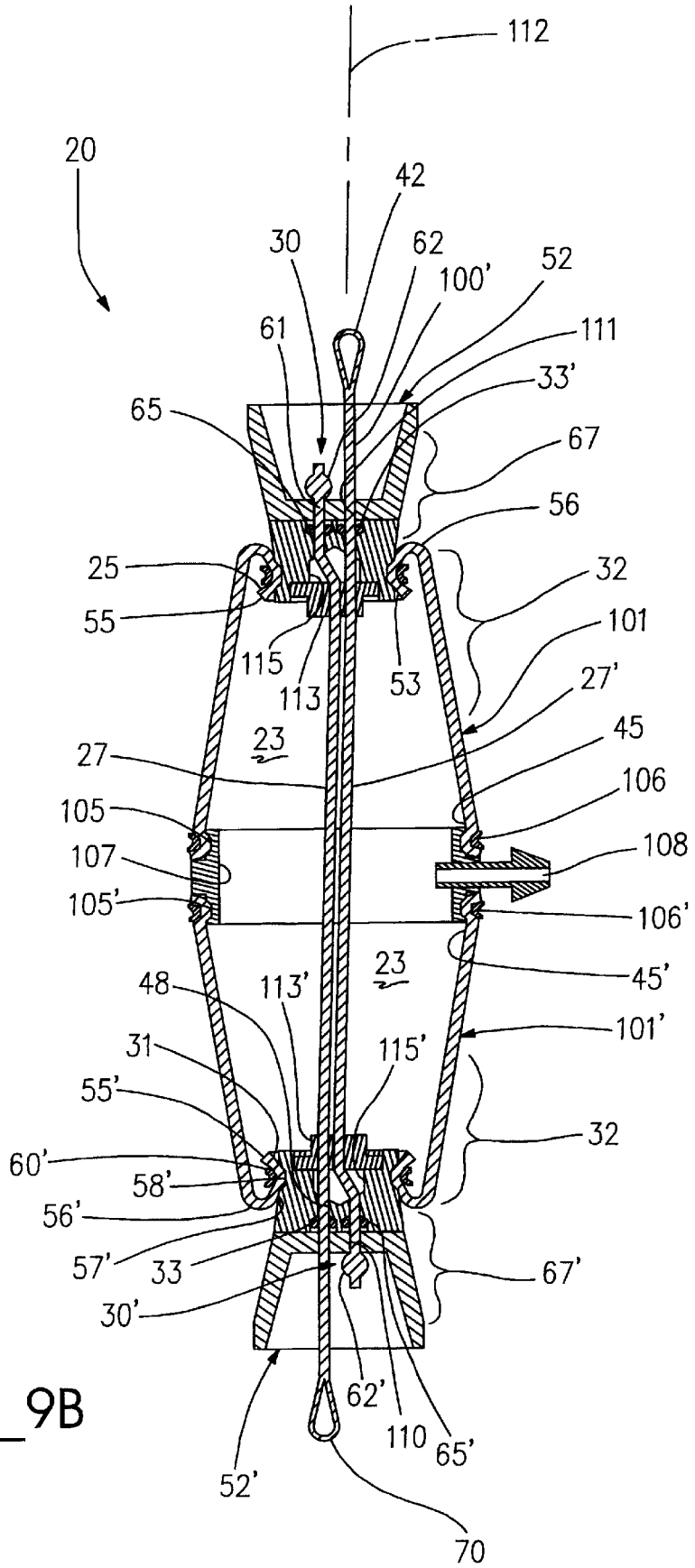

Referring now to FIGS. 9A and 9B, a dual-sided actuator assembly 20 is provided having a bladder device 22 configured to displace both the bladder proximal portion 25 and the bladder distal portion 26 in opposed directions. Briefly, the distal portion 26 of the flexible bladder device 22 is further adapted to substantially directionally displace between the deflated condition (FIG. 9A) and the inflated condition (FIG. 9A) which displaces the bladder distal portion 26 away from the bladder proximal portion 25 of the bladder device 22. An elongated ligament member, generally designated 27', is included having a proximal portion 100', oriented outside the chamber 23, and an anchor portion 30', spaced-apart from the ligament proximal portion 100'. The ligament anchor portion 30' extends into the chamber 23 through proximal opening 53 in the bladder device 22 positioned proximate the bladder proximal portion 25 thereof. The ligament anchor portion 30' is coupled proximate to the bladder distal portion 26 in a manner adapted to: selectively invert foldable portions 32' of the bladder distal portion 26 when displaced toward the deflated condition to position the ligament anchor portion 30' and the bladder distal portion 26 relatively closer to the bladder proximal portion 25; and selectively evert the inverted foldable portions 32' of the bladder distal portion 26 when displaced toward the inflated condition to position the ligament anchor portion 30' and the bladder distal portion 26 relatively farther away from the bladder proximal portion 25. The ligament member 27' can then be selectively moved between a lengthened condition (FIG. 9A) and a shortened condition (FIG. 9B), respectively. A second sliding seal 33' is formed in the bladder proximal opening 53 between the bladder device 22 and the ligament member 27' to sufficiently seal the bladder chamber 23 during reciprocating movement between the lengthened condition and the shortened condition.

Accordingly, a dual action bladder device 22 is provided essentially divided into a distal bladder 101' and a proximal bladder 101 which inflate from the deflated condition (FIG. 9A) to the inflated condition (FIG. 9B) in opposite directions. As best shown in FIG. 9B, the distal bladder 101' and the proximal bladder 101 share a common chamber 23 so that the opposed bladders preferably inflate simultaneously. In turn, the tendon member 27 moves from the extended condition to the retracted condition, while the ligament member 27' moves from the lengthened condition to the shortened condition. This configuration is advantageous in that the proximal securing device becomes a ligament member which is smaller and less expensive than a tubular sheath member. In addition, the proximal attachment is much smaller.

In the preferred embodiment, an annular-shaped, central support ring 103 is positioned proximate and coupled to a central portion of the bladder device for structural support thereof. Support ring 103 preferably bisects the bladder device into the distal bladder 101' and the proximal bladder 101, and includes two or more annular grooves 105, 105' each extending circumferentially about the support ring 103 to facilitate seal formation with the bladder interior wall 45, 45' of the proximal bladder 101 and the distal bladder 101', respectively. Mating annular-shaped central crimp devices 106, 106' cooperate with the respective annular groove 105, 105' to urge the respective bladder interior wall 45, 45' of the proximal bladder 101 and the distal bladder 101' into seal engaging contact with support ring 103 to form a sufficient seal therewith.

Central support ring 103 provides a central passageway 107 which enables fluid communication between the bladder chambers. Hence, inflation of common chamber 23 causes both the proximal bladder 101 and the distal bladder 101' to simultaneously inflate. It will be understood, however, that the chambers of the proximal and distal bladders may be separate and independent of one another for independent inflation without departing from the true spirit and nature of the present invention.

The central support ring 103 preferably includes a central pressure port 108 extending into the common chamber 23 to enable fluid communication with a pressure source (not shown) for inflation and deflation of the chamber to displace the displaceable portions 56 between the inflated condition and deflated condition, respectively, and displace the foldable portions 32' between the inflated condition and deflated condition, respectively.

Similar to proximal support plug 52 of the proximal bladder 101, a distal support plug 52' is provided which is situated in the distal opening 31 of distal bladder 101'. FIG. 9B illustrates that the distal support plug 52' is positioned between the distal portion of the bladder device 22 and the ligament anchor portion 30' to mount the ligament member 27' to the bladder distal portion 26.

To facilitate inversion and eversion of the foldable portions 32' of the distal bladder 101' during inflation and deflation thereof, the distal edge 55 of the bladder distal portion 26 is inverted radially inward toward and into the chamber 23. Inversion and eversion of the foldable portions 32' of distal bladder 101' is facilitated as the distal support plug 52' is urged axially back and forth during reciprocation between the retracted and extended conditions. Similar to displaceable portion 32 of the proximal bladder 101, the foldable portions 56 includes a circular, distal inversion fold 56' which is caused to be displaced linearly along the longitudinal axis of the bladder chamber 23 between the deflated condition and the inflated condition. As the bladder device 22 is inflated toward the inflated condition, distal inversion fold 56' is urged in the direction of arrow 41' , while the proximal inversion fold 56 is urged in the opposite direction of arrow 41. As illustrated in FIG. 9B, the distal support plug 52' and the proximal support plug 52 are urged away from one another during inflation of bladder device 22. Consequently, portions of tendon member 27 and of the ligament member 27' are drawn into chamber 23 toward the retracted condition.

At the inverted bladder distal portion 26, a distal engaging surface 57' of the distal bladder 101', in the form of an annular slot, cooperates with a distal mounting surface 58' of the distal support plug 52' to form a seal therewith. An annular-shaped, support plug crimp device 60' is further employed to sealably engage the distal engaging surface 57' of the distal bladder 101' into contact with the distal mounting surface 58' of the distal support plug 52' to form a sufficient seal therebetween.

In this configuration, the distal support plug 52' includes distal tendon aperture 48 extending axially therethrough into chamber 23 which is formed for reciprocating receipt of the tendon member 27 therein, as well as an axially extending distal passageway 110 having a diameter substantially similar to that of the ligament member 27'. This distal passageway 110 is formed for receipt of the ligament anchor portion 30' of the ligament member 27' therethrough for mounting thereof to the distal support plug 52'. The ligament anchor portion 30' is preferably situated at the distal end of the ligament member 27' and is preferably provided by a distal stop member 62' having a diameter larger than distal passageway 61' to prevent movement therethrough. A distal seal 65' is positioned in distal passageway 110 and is sized to cooperate with the reciprocating ligament member for sealing thereof.

The proximal support plug 52 further includes a proximal ligament aperture 111 extending axially therethrough into chamber 23 which is formed for reciprocating receipt of the ligament member 27' therein. Preferably, the ligament aperture 111 includes a proximal seal recess sized to accommodate a proximal sliding seal 33 therein to slidingly seal the chamber 23 from the exterior environment outside the proximal bladder 101.

Employing a similar technique as that of the ligament member 27', it will be appreciated that the pressure spool of the previous embodiments may incorporate a ligament member as the securing device (not shown) to function as a proximal attachment. In this configuration, the ligament member would have an anchor portion mounted to the pressure spool, while the proximal end extends through the chamber and out through a ligament aperture formed in the proximal support plug for sliding support therewith.

Each of the proximal support plug 52 and the distal support plug 52' includes an opposed off-set disk 113, 113' adapted to position the respective portions of the ligament member 27' and the tendon member 27 such that the portion of each respective member, where it enters the bladder, is axially aligned with the support plug to which it is fixed. This ensures that the support plug is loaded symmetrically. As the tendon member 27 and the ligament member 27' move to the retracted condition and the shortened condition, respectively (FIG. 9B), the opposed tensile forces align centrally about the longitudinal axis 112. Each support plug further includes an off-set chamber 115, 115' which cooperates with the respective off-set disk 113, 113' to enable the off-set of the ligament member and the tendon member by an amount determined by the space requirements of the seals.

Referring back to FIGS. 9A and 9B, it can be seen that inflation skewing occurs due to the tendon and ligament being offset, since the tendon terminating in a given support plug occupies the center requiring the sliding tendon to be offset. The amount of off-set, which is more apparent in the deflated condition, is determined by the balance between the tendency for the tendon and the ligament to straighten under tension, and the opposing tendancy of the bladder to remain axially symmetrical.

Similar to the proximal support plug 52, the distal support plug 52' also provides an elongated, cylindrical-shaped distal support surface 67' extending axially from the distal mounting surface 58' and in a direction away from the proximal support plug 52 and chamber 23. As best viewed in FIG. 9A, when the distal bladder 101' and the distal support plug 52' are oriented in the deflated condition, the inverted foldable portions 32' are radially supported against the distal plug support surface 67'.

The distal support surface 67' of the distal support plug 52' tapers outwardly and away from chamber 22. Similar to the outward taper of the proximal support surface 67 of the proximal support plug 52, the outward taper of the distal support plug 52' is substantially the same slope as the inward taper of the distal portion 26 of the distal bladder 101'.

The tapered proximal and distal bladders enable the actuator assembly 20 to inflate substantially symmetrically about central support ring 103. Since the forces generated by the tendon member 27 and ligament member 27' are a function of the transverse, cross-sectional area of the respective inversion fold, the bladder inflation equalizes for a symmetric inflation. For example, if the proximal bladder tends to inflate at a greater rate than distal bladder, the proximal bladder will eventually generate less force than the distal bladder. Subsequently, the rate of inflation of the distal bladder will proportionately increase, thereby maintaining symmetrical inflation.

Figure 10A:
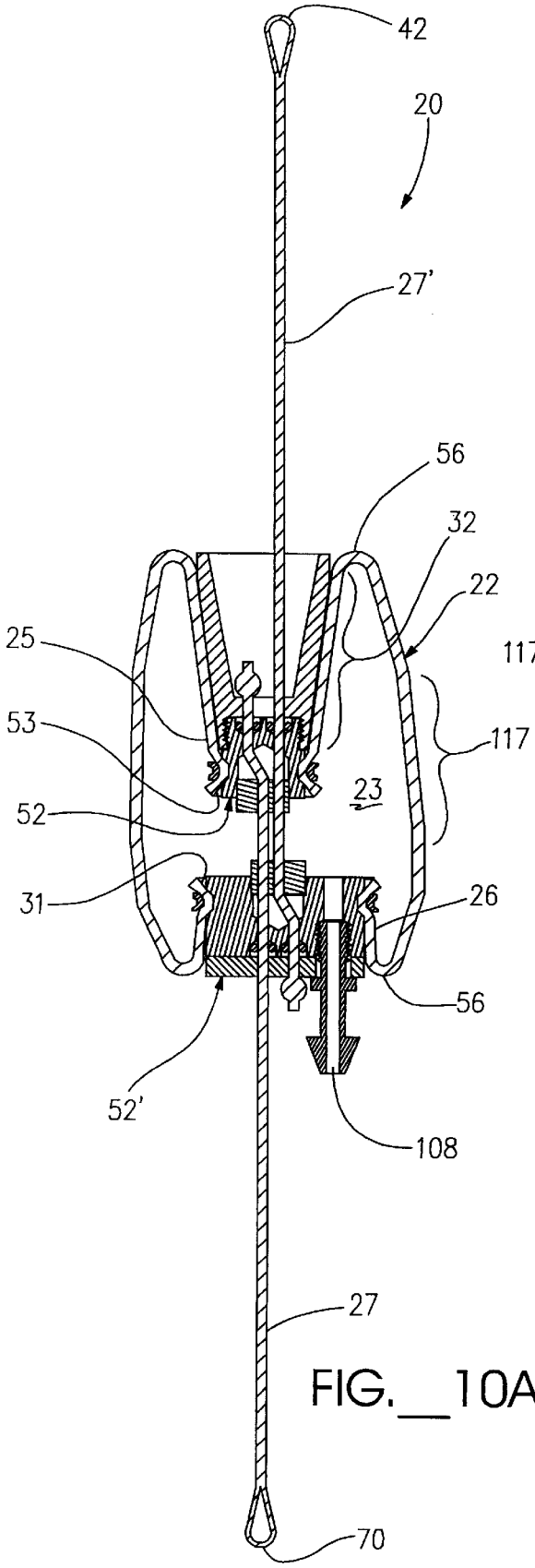
FIGS. 10A and 10B is a sequence of side elevation views, in cross-section, of an alternative embodiment of the flexible actuator assembly of FIGS. 9A and 9B illustrating asymmetric inflation of the two opposed bladder devices.
Figure 10B:
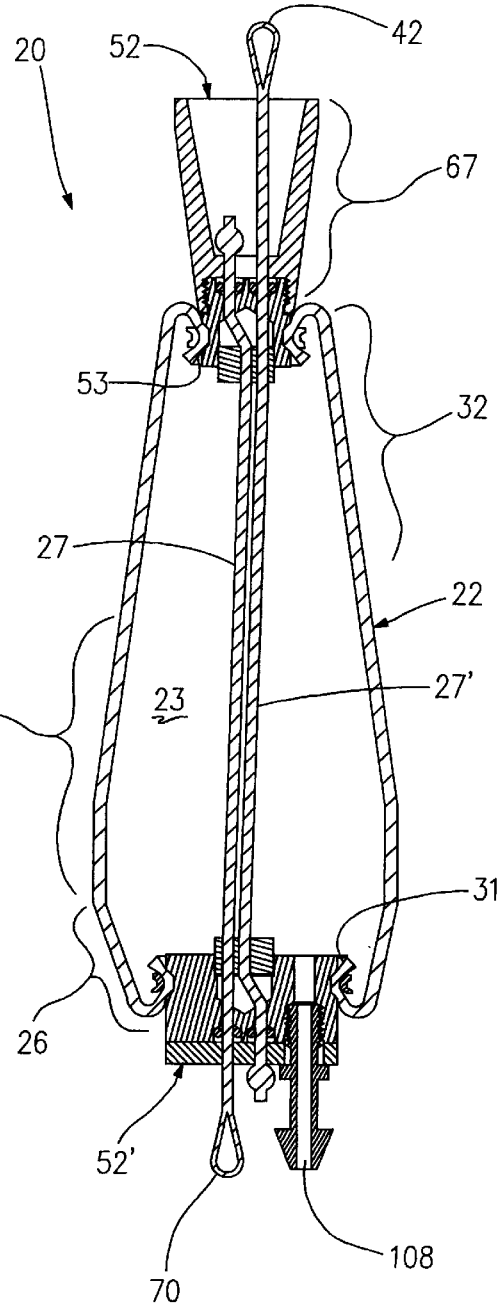
Figure 12:
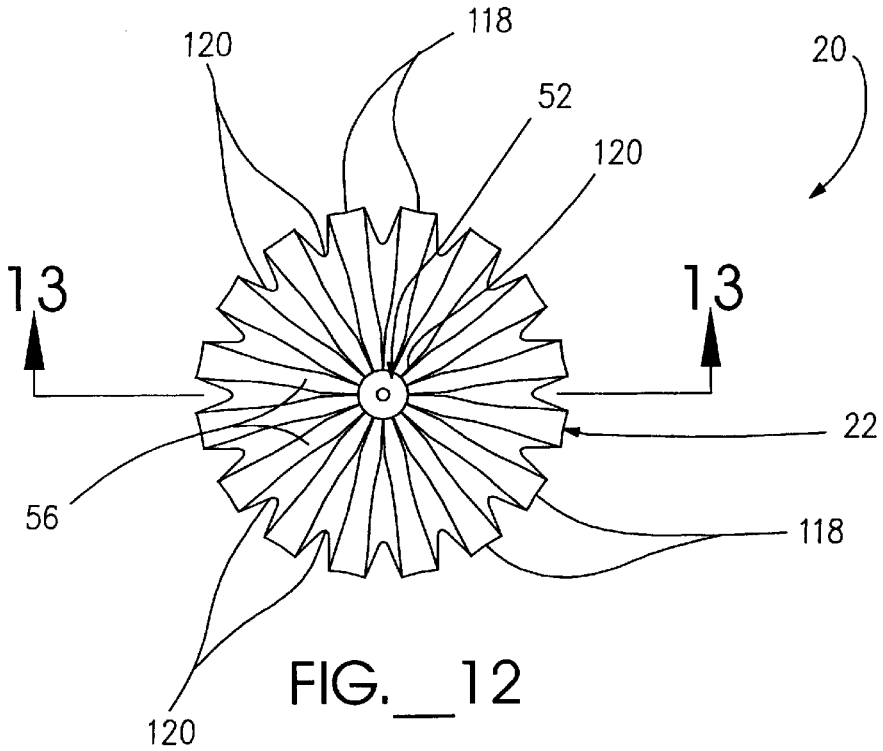
FIG. 12 is a top plan view of the ribbed bladder embodiment of FIG. 11.
Figure 11:
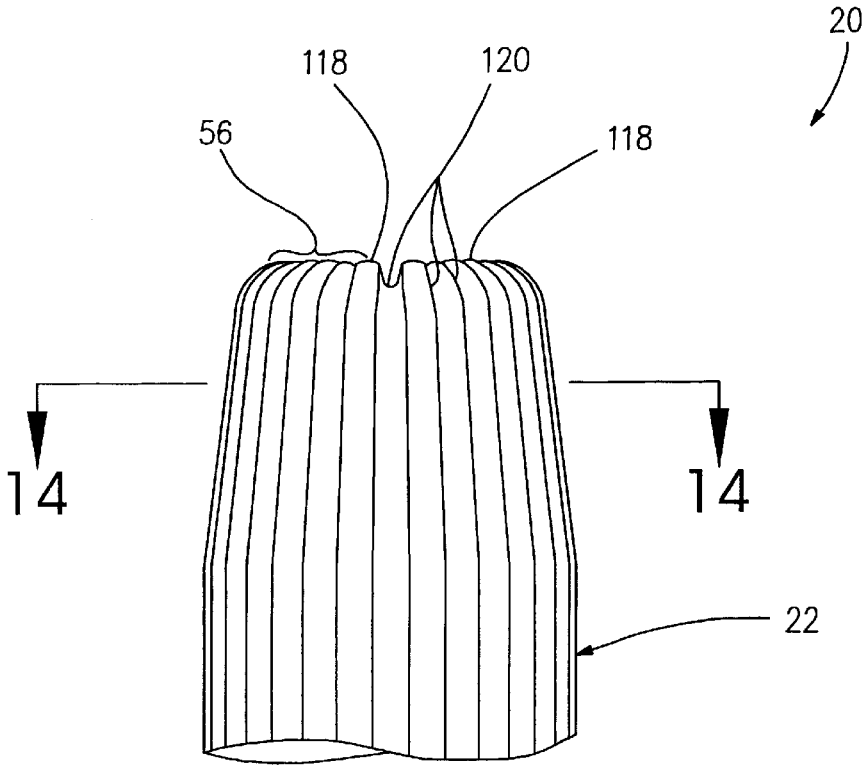
FIG. 11 is an enlarged, fragmentary side elevation view of the inversion fold portion of an alternative embodiment bladder device which incorporates longitudinally extending flexible ribs.

FIGS. 10A and 10B illustrate another alternative embodiment of a bladder device 22 configured for asymmetrical inflation between the deflated condition and the inflated condition. As best viewed in the inflated condition of FIG. 10B, the bladder distal portion tapers inwardly at a greater rate than that of the bladder proximal portion 25. Thus, the central portion 117 of the bladder device 22 axially displaces by an amount proportional to the relative taper of the bladder distal portion 26 and the bladder proximal portion 25. For example, the gradual inward taper of the bladder proximal portion 25 enables a much larger axial displacement than the bladder distal portion which is inwardly tapered at a steeper slope.

In this configuration, the distal support plug 52' is fixed relative to the proximal attachment by ligament member 27', establishing a frame of reference which is axially fixed. During inflation of the bladder device 22 from the deflated condition (FIG. 10A) to the inflated condition (FIG. 10B), the bladder central portion 117 displaces toward the proximal attachment 42 by an amount that the distal portion 26 of bladder device 22 inflates. Hence, by controlling the length of the distal portion 26, the amount of displacement of the bladder central portion can be made to simulate the appearance of a real muscle. Further, to ensure that the bladder distal portion 26 and bladder proximal portion 25 inflates simultaneously, both bladders should cover the same range of diameters.

In another alternative embodiment, as shown in FIGS. 11–14, the bladder device 22 may include longitudinally extending support ribs 118 which alternately define longitudinally disposed grooves 120 therebetween which extend substantially parallel to the actuator longitudinal axis 112. The support ribs increase the thickness of the bladder wall while the grooves 120 promote flexibility during inversion and eversion of the inversion fold 56.

Figure 14:
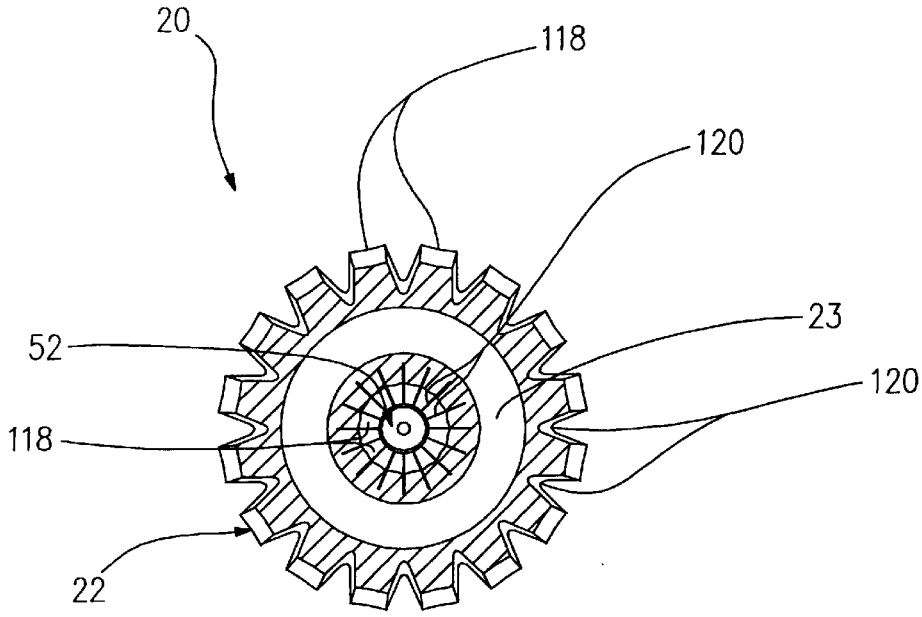
FIG. 14 is a top plan view, in cross-section, of the ribbed bladder embodiment taken substantially along the plane of the line 14—14 in FIG. 12.
Figure 13:
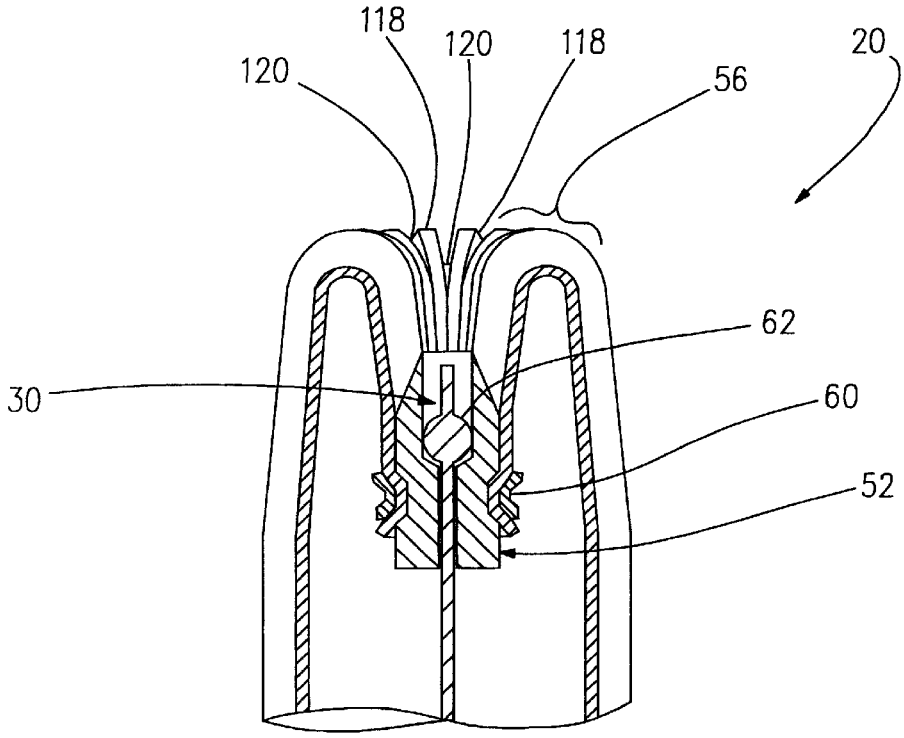
FIG. 13 is a fragmentary, side elevation view, in cross-section, of the ribbed bladder embodiment taken substantially along the plane of the line 13—13 in FIG. 11.

Moreover, when the displaceable portions 56 of the bladder device are inverted, the adjacent ribs 118 flexibly cooperate with one another to eliminate the alternating grooves 120 (FIG. 14). Since the support ribs 118 come together and cooperate to form a thick wall at the inverted displaceable portion 32 of the bladder, the inversion fold 56 becomes more resistant to circumferential buckling and kinking or cusp formation. This limits the minimum circumferential radius of curvature at the inversion fold, reducing the stress in the bladder thereat. Upon eversion of the displaceable portions 56 of the bladder device, the everted grooves 120 open back up which allows the bladder to bend and expand easily around the inversion fold 56.

The support ribs 118 and grooves 120 of this embodiment are further employed to reduce the frictional force and, therefore, the normal force between the bladder device and the support plug 52. The ribs 118 can be designed in such a way that they support the compressive loads in the bladder device to an extent that the inverted displaceable portions becomes substantially self supporting. This, in turn, reduces the amount of normal force required from the support plug. A support surface 67 of the support plug, accordingly, would not be necessary for this embodiment. This further adds the benefit of reducing the overall length of the actuator assembly 20 when in the inflated condition since the support surface would not be extending away from the bladder device.

While specific embodiments have been illustrated and described in the figures, it will be understood that any component combination may be provided without departing from the true spirit and nature of the present invention.

What is claimed is:

1. A flexible actuator assembly comprising:

a flexible bladder device defining an expandable chamber, between a proximal portion and an opposite distal portion thereof, adapted to substantially directionally displace between a deflated condition and an inflated condition, displacing said proximal portion away from said distal portion;

an elongated tendon member having a distal portion, oriented outside the chamber, and an anchor portion, spaced-apart from the tendon distal portion, extending into said chamber through a distal opening in said bladder device positioned proximate the bladder distal portion thereof, the anchor portion being coupled proximate to the bladder proximal portion in a manner adapted to selectively invert displaceable portions of the bladder device when displaced toward the deflated condition to position the anchor portion and the bladder proximal portion relatively closer to the bladder distal portion, and selectively evert the inverted displaceable portions of the bladder device when displaced toward the inflated condition to position the anchor portion and the bladder proximal portion relatively farther away from the bladder distal portion for selective movement of the tendon member between an extended condition and a retracted condition, respectively; and a sliding seal formed in the bladder distal opening between the bladder device and said tendon member to sufficiently seal said chamber during reciprocating movement between the retracted condition and the extended condition.

2. The flexible actuator assembly according to claim 1 wherein, said bladder device is elongated and configured to displace substantially along a longitudinal axis thereof.

3. The flexible actuator assembly according to claim 2 further including:

a securing device adapted to provide tensile support to said bladder device for proximal attachment of said actuator assembly.

4. The flexible actuator assembly according to claim 3 wherein, said securing device includes an elongated sheath member substantially surrounding said bladder device and defining a cavity at a proximal portion thereof formed for receipt of the displacing bladder device when everted toward the inflated condition.

5. The flexible actuator assembly according to claim 4 wherein, said sheath member is adapted to substantially constrain radial expansion of said chamber during displacement of said bladder device from the deflated condition to the inflated condition.

6. The flexible actuator assembly according to claim 3 wherein, a distal portion of said securing device is coupled to the bladder distal portion.

7. The flexible actuator assembly according to claim 1 wherein, said chamber of said bladder device tapers inwardly toward the bladder proximal portion.

8. The flexible actuator assembly according to claim 1 further including:

a pressure port extending into said chamber to enable fluid communication for inflation and deflation of said chamber to displace said bladder device between the inflated condition and deflated condition, respectively.

9. The flexible actuator assembly according to claim 1 further including:

a pressure spool positioned in said bladder distal opening and adapted cooperate with the bladder distal portion to sufficiently seal said chamber, said spool further defining an aperture extending therethrough for reciprocating receipt of said tendon member between the extended condition and the retracted condition.

10. The flexible actuator assembly according to claim 9 wherein, the spool aperture is sized and dimensioned to support the sliding seal therein.

11. The flexible actuator assembly according to claim 10 wherein, said spool defines a pressure port extending into said chamber to enable fluid communication for inflation and deflation of said chamber to displace said bladder device between the inflated condition and deflated condition, respectively.

12. The flexible actuator assembly according to claim 1 further including:

a support plug positioned between said bladder device and the tendon anchor portion to mount said tendon member to the bladder device proximate the bladder proximal portion.

13. The flexible actuator assembly according to claim 12 wherein, said bladder proximal portion defines a proximal opening into said chamber formed and dimensioned for sealed receipt of said support plug therein.

14. The flexible actuator assembly according to claim 13 wherein, an engaging surface of the bladder proximal portion being inverted inwardly into said chamber to define said proximal opening.

15. The flexible actuator assembly according to claim 14 wherein, said support plug defines a mounting surface adapted to cooperate with the inverted engaging surface of said bladder device to form a sufficient seal therewith.

16. The flexible actuator assembly according to claim 15 wherein, said support plug further defining an elongated support surface extending proximally away from said mounting surface, and formed to provide radial support to the inverted displaceable portions of said bladder device when oriented in said deflated condition.

17. The flexible actuator assembly according to claim 16 wherein, said support surface is substantially cylindrical-shaped.

18. A flexible actuator assembly comprising:

an elongated flexible bladder device having an expandable chamber between a first portion and an opposite second portion thereof, proximal said first portion defining a first opening into said chamber and a second portion defining a second opening into said chamber, said bladder device being formed and dimensioned to substantially directionally expand substantially along a longitudinal axis thereof between a deflated condition and an inflated condition, displacing the bladder second portion away from the bladder first portion;

an elongated support plug configured to cooperate with said first portion of the bladder device to hermetically seal the bladder first opening;

an elongated tendon member extending through the bladder second opening having a distal portion oriented outside the chamber and an anchor portion coupled to said support plug in said chamber in a manner adapted to selectively invert displaceable portions of the bladder device when displaced toward the deflated condition to position the anchor portion and the bladder second portion relatively closer to the bladder first portion, and selectively evert the inverted displaceable portions of the bladder device when displaced toward the inflated condition to position the anchor portion and the bladder second portion relatively farther away from the bladder first portion for selective movement of the tendon member between an extended condition and a retracted condition, respectively; and a sliding seal formed in the bladder distal opening between the first portion of the bladder and said tendon member to sufficiently seal said chamber during reciprocating movement between the extended condition and the retracted condition.

19. The flexible actuator assembly according to claim 18 wherein, said second opening is positioned substantially at a bladder distal portion, and said first opening is positioned substantially at the bladder proximal portion.

20. The flexible actuator assembly according to claim 19 further including:

a constraining structure cooperating with said bladder device to substantially restrict radial expansion thereof during inflation from the deflated condition to the inflated condition, and promote longitudinal displacement of the bladder proximal portion from the bladder distal portion substantially along the longitudinal axis thereof.

21. The flexible actuator assembly according to claim 20 wherein, said constraining structure includes an elongated sheath member substantially surrounding said bladder device and defining a cavity at a proximal portion of the constraining structure formed for receipt of the displacing bladder device when everted toward the inflated condition.

22. The flexible actuator assembly according to claim 21 wherein, said cavity of said sheath member tapers inwardly toward the sheath proximal portion.

23. The flexible actuator assembly according to claim 19 further including:

a pressure port extending into said chamber to enable fluid communication for inflation and deflation of said chamber to displace said bladder device between the inflated condition and deflated condition, respectively.

24. The flexible actuator assembly according to claim 21 further including:

a substantially rigid spool positioned in said bladder second opening and adapted cooperate with the second portion of the bladder device to sufficiently seal said chamber, said spool further defining an aperture extending therethrough sized and dimensioned to support the sliding seal therein.

25. The flexible actuator assembly according to claim 21 wherein, the first portion of the bladder device is inverted inwardly into said chamber and adjacent a mounting surface of the support plug adapted to cooperate with said first portion to form a hermetic seal therewith.

26. The flexible actuator assembly according to claim 25 wherein, said support plug further defining an elongated support surface extending away from said mounting surface and toward the sheath proximal portion, said support plug being formed to provide radial support to the inverted displaceable portions of said bladder device when oriented in said deflated condition.

27. The flexible actuator assembly according to claim 26 further including:

a pressure port extending into said chamber to enable fluid communication for inflation and deflation of said chamber to displace said bladder device between the inflated condition and deflated condition, respectively.

28. The flexible actuator assembly according to claim 21 wherein, said tendon member defining a passageway extending therethrough and into said chamber to enable fluid communication for inflation and deflation of said chamber to displace said bladder device between the inflated condition and deflated condition, respectively.

* * * * *